US011071340B2

(12) United States Patent
Lavallee et al.

(10) Patent No.: US 11,071,340 B2
(45) Date of Patent: Jul. 27, 2021

(54) PROTECTIVE PANT

(71) Applicants: Alexandre Lavallee, Morin-Heights (CA); Jean-Marie Bidal, St-Jerome (CA); Pascal Martel, Montreal (CA)

(72) Inventors: Alexandre Lavallee, Morin-Heights (CA); Jean-Marie Bidal, St-Jerome (CA); Pascal Martel, Montreal (CA)

(73) Assignee: BAUER HOCKEY, LLC, Exeter, NH (US)

( * ) Notice: Subject to any disclaimer, the term of this patent is extended or adjusted under 35 U.S.C. 154(b) by 1062 days.

(21) Appl. No.: 14/978,767

(22) Filed: Dec. 22, 2015

(65) Prior Publication Data

US 2016/0174623 A1 Jun. 23, 2016

(30) Foreign Application Priority Data

Dec. 23, 2014 (CA) ..... CA 2876433

(51) Int. Cl.

| | |
|---|---|
| ***A41F 9/00*** | (2006.01) |
| ***A41D 31/18*** | (2019.01) |
| ***A41D 13/015*** | (2006.01) |
| ***A41D 1/08*** | (2018.01) |

(52) U.S. Cl.

CPC ..... *A41D 31/185* (2019.02); *A41D 1/088* (2013.01); *A41D 13/0153* (2013.01); *A41F 9/002* (2013.01); *A41D 2600/10* (2013.01)

(58) Field of Classification Search

CPC ..... A41F 9/002; A41D 1/088; A41D 13/0015; A42D 1600/10; A42D 31/185

See application file for complete search history.

(56) References Cited

U.S. PATENT DOCUMENTS 156,170 A 10/1874 Loewenstein
849,060 A * 4/1907 Freidbaum ..... A41F 9/00 2/236
888,063 A 5/1908 Brooks (Continued)

FOREIGN PATENT DOCUMENTS

CA 2464782 10/2005
CA 2876433 A1 6/2016

OTHER PUBLICATIONS

Bauer 2011 Product Catalog, Bauer Supreme Totalone pants, 3 pages.

(Continued)

*Primary Examiner* — Richale L Quinn

(57) ABSTRACT

A protective pant for a wearer, comprising a pelvic portion for overlying a pelvic region of the wearer to provide impact protection to the pelvic region, leg portions for overlying thighs of the wearer to provide impact protection to the thighs, and a zipperless length adjuster configured to adjust a length of the protective pant. Also, a protective pant for a wearer, the protective pant comprising: an inner base for protecting a pelvic region of the wearer; an outer shell; and a zipperless length adjuster comprising a plurality of adjustment elements on the inner base and a plurality of adjustment elements on the outer shell, each of the adjustment elements on the outer shell configured to be attachable to a corresponding one of the adjustment elements of the inner base in at least two positions to permit length-wise adjustment of the outer shell relative to the inner base.

44 Claims, 21 Drawing Sheets

(56) References Cited

U.S. PATENT DOCUMENTS 1,072,776 A 9/1913 Routery
1,107,158 A 8/1914 Day
1,614,965 A 1/1927 Mordicha
1,998,085 A 4/1935 Wilcox
2,242,365 A 5/1941 Muhr
2,663,027 A 12/1953 Posson
2,977,601 A 4/1961 Winston
3,007,173 A 11/1961 Gongoll
3,484,868 A * 12/1969 Davenport, Jr. ..... A63B 71/12 2/465
3,574,237 A 4/1971 Reynolds
4,188,672 A 2/1980 Kalso
4,325,148 A 4/1982 Livernois
4,561,121 A 12/1985 Ehring
4,811,427 A 3/1989 Regan
5,036,548 A 8/1991 Grilliot
5,123,120 A * 6/1992 Ross ..... A41D 13/02 2/229
5,136,724 A 8/1992 Grilliot
5,289,590 A 3/1994 Larson
5,471,680 A * 12/1995 Vesterinen ..... A41D 13/0525 2/338
5,539,927 A 7/1996 Holubec
5,819,320 A 10/1998 Jolla
5,926,856 A 7/1999 Duval
6,105,169 A 8/2000 Colorado
6,205,591 B1 3/2001 Wheeler
6,317,893 B1 11/2001 Walton
6,327,715 B1 * 12/2001 Castiglione ..... A41D 1/082 2/227
6,490,733 B1 * 12/2002 Casaubon ..... A41D 13/0007 2/79
6,637,036 B2 * 10/2003 Beland ..... A41D 1/08 2/227
6,665,882 B1 12/2003 Pedrick
6,698,031 B2 3/2004 Lewis
6,701,533 B2 3/2004 Webb
6,782,559 B2 8/2004 Regan
6,789,270 B1 9/2004 Pedrick
6,804,832 B2 * 10/2004 Beland ..... A41D 1/08 2/227
6,990,687 B2 1/2006 Snedeker
7,047,567 B2 * 5/2006 Allen ..... A41D 13/0007 2/69
7,574,752 B1 8/2009 Walters
7,596,816 B1 10/2009 Henry
7,694,349 B2 * 4/2010 Skottheim ..... A41D 13/015 2/212
7,836,519 B2 11/2010 Zahler
7,937,767 B2 * 5/2011 Leach ..... A41B 11/12 2/22
8,074,298 B2 12/2011 Davenport
8,104,100 B2 1/2012 Razzaghi
8,146,170 B2 * 4/2012 Goodhand ..... A41D 13/0015 2/22
8,161,573 B1 4/2012 Burns-Cox
8,316,468 B2 * 11/2012 Skottheim ..... A41D 1/08 2/227
8,667,615 B2 3/2014 Vanderburgh
8,782,813 B2 7/2014 Usami
8,813,266 B1 * 8/2014 Green ..... A41D 1/062 2/229
8,914,917 B1 * 12/2014 Huntsman ..... A41D 13/0556 2/22
8,966,667 B2 * 3/2015 Peck ..... A41D 1/08 2/227
9,015,867 B2 4/2015 Kenney
9,101,789 B2 8/2015 Schierenbeck
9,861,146 B2 * 1/2018 Martel ..... A41D 13/0153
2002/0042944 A1 * 4/2002 Beland ..... A41D 1/08 2/465
2004/0163159 A1 8/2004 Edwards
2005/0223462 A1 10/2005 Snedeker
2005/0246820 A1 11/2005 Davenport
2006/0282938 A1 12/2006 Jewell et al.
2007/0000012 A1 1/2007 Davenport
2007/0044212 A1 * 3/2007 Contant ..... A41D 13/0153 2/461
2007/0101474 A1 * 5/2007 Skottheim ..... A41D 13/0575 2/69
2007/0234467 A1 * 10/2007 Leach ..... A41B 11/12 2/227
2010/0199402 A1 8/2010 Curtis
2011/0179556 A1 7/2011 Partovi
2012/0096627 A1 * 4/2012 Gosse ..... A41D 1/082 2/227
2013/0212772 A1 8/2013 Apostoloff
2013/0291277 A1 * 11/2013 Kirkwood ..... A41D 1/22 2/69
2014/0304882 A1 10/2014 Lloyd
2014/0317832 A1 * 10/2014 Allen ..... A41D 1/06 2/236
2016/0174623 A1 * 6/2016 Lavallee ..... A41D 13/0153 2/466
2016/0174627 A1 6/2016 Martel et al.

OTHER PUBLICATIONS

CCM-Reebok Hockey Catalog 2011, Reebok 9k Pants, 2 pages.
Reebok Hockey Catalog 2011, Reebok 11k Pants, 2 pages.
Non-Final Office Action issued by the United States Patent and Trademark Office dated Apr. 7, 2017 in connection with U.S. Appl. No. 14/978,737—22 pages.

* cited by examiner

PROTECTIVE PANT

FIELD

This application relates to a protective pant for use in playing sports such as hockey.

BACKGROUND

Traditionally, protective pants such as hockey pants used by hockey players have been formed as an oversized pair of shorts including protective padding.

A fit of a protective pant can impact a player's mobility and may therefore require replacement, particularly when outgrown by the player. Given the expense and inconvenience of having to purchase or otherwise obtain a new protective pant, an improved protective pant would be welcomed.

SUMMARY

According to various aspects of the invention, there is provided a protective pant for a wearer. The protective pant comprises a pelvic portion for overlying a pelvic region of the wearer to provide impact protection to the pelvic region of the wearer, leg portions for overlying thighs of the wearer to provide impact protection to the thighs of the wearer, and a zipperless length adjuster configured to adjust a length of the protective pant.

According to another aspect of the invention, there is provided a protective pant for a wearer, the protective pant comprising: an inner base for protecting a pelvic region of the wearer; an outer shell; and a zipperless length adjuster comprising a plurality of adjustment elements on the inner base and a plurality of adjustment elements on the outer shell, each of the adjustment elements on the outer shell configured to be attachable to a corresponding one of the adjustment elements of the inner base in at least two positions to permit length-wise adjustment of the outer shell relative to the inner base.

According to another aspect of the invention, there is provided an inner base for a protective pant. The inner base comprises at least one adjustment element configured to be attachable to a corresponding one of at least one adjustment element on an outer shell of the protective pant in at least two positions to permit zipperless length-wise adjustment of the inner base relative to the outer shell.

According to another aspect of the invention, there is provided a removable outer shell for covering an inner base of a protective pant. The removable outer shell comprises at least one adjustment element configured to be attachable to a corresponding one of at least one adjustment element of the inner base in at least two positions to permit zipperless length-wise adjustment of the removable outer shell relative to the inner base.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of the embodiments of the present invention is provided herein below, by way of example only, with reference to the accompanying drawings, in which.

DETAILED DESCRIPTION OF EMBODIMENTS

Figure 1A:
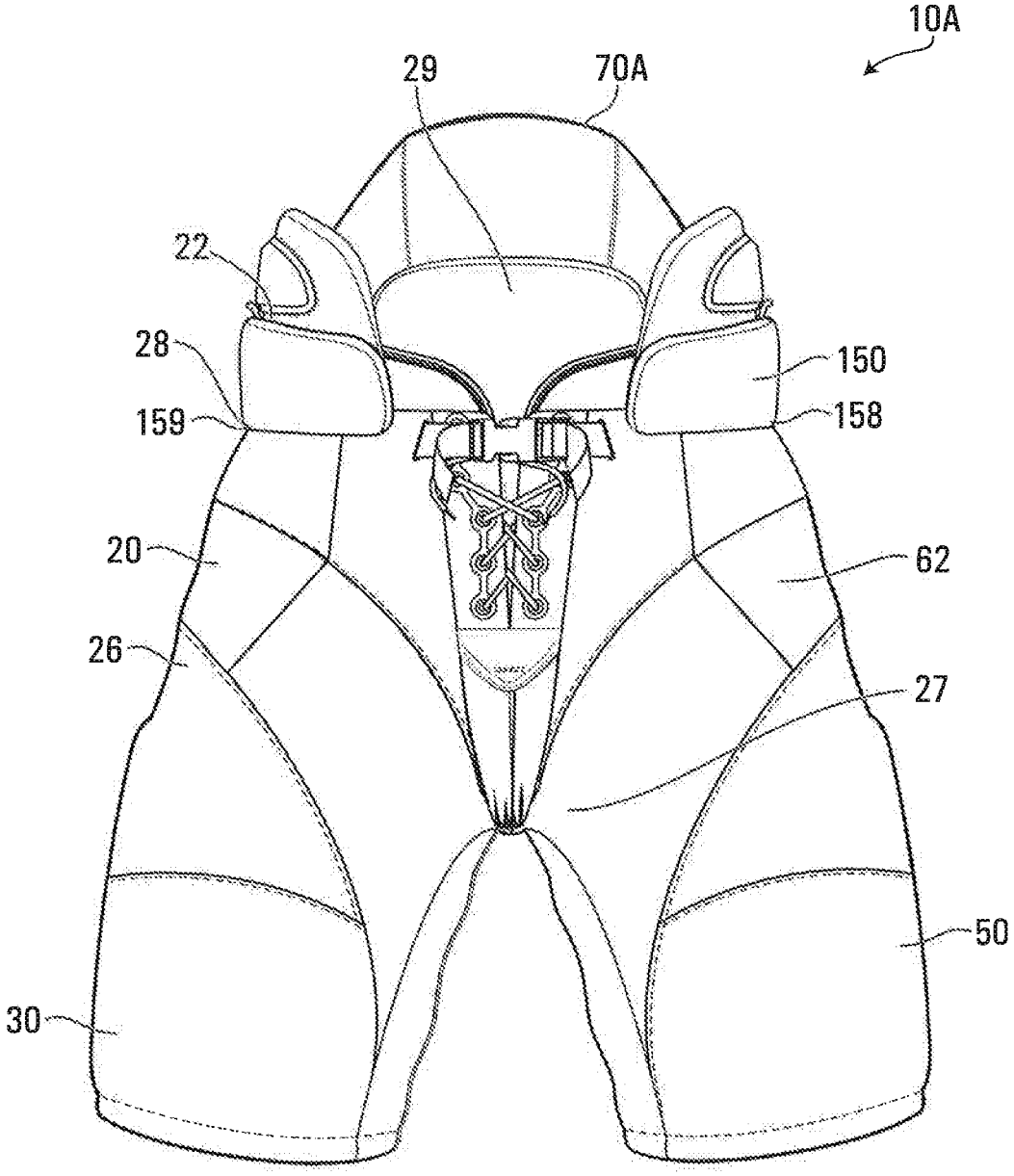
FIG. 1A is a front view of an example of a protective pant in accordance with an embodiment of the invention.
Figure 2:
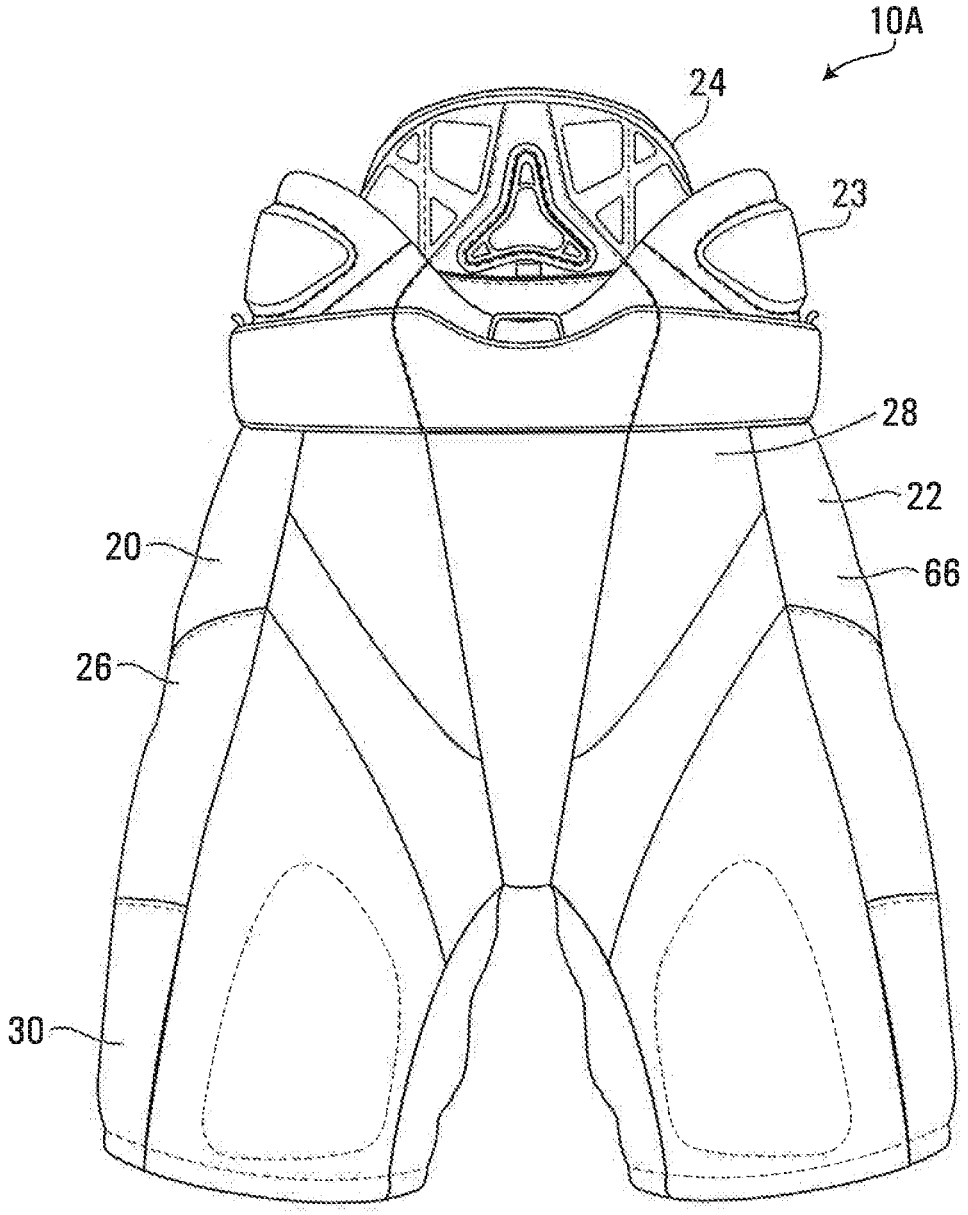
FIGS. 2 and 3 are respective side and rear views of the protective pant in FIG. 1A.
Figure 3:
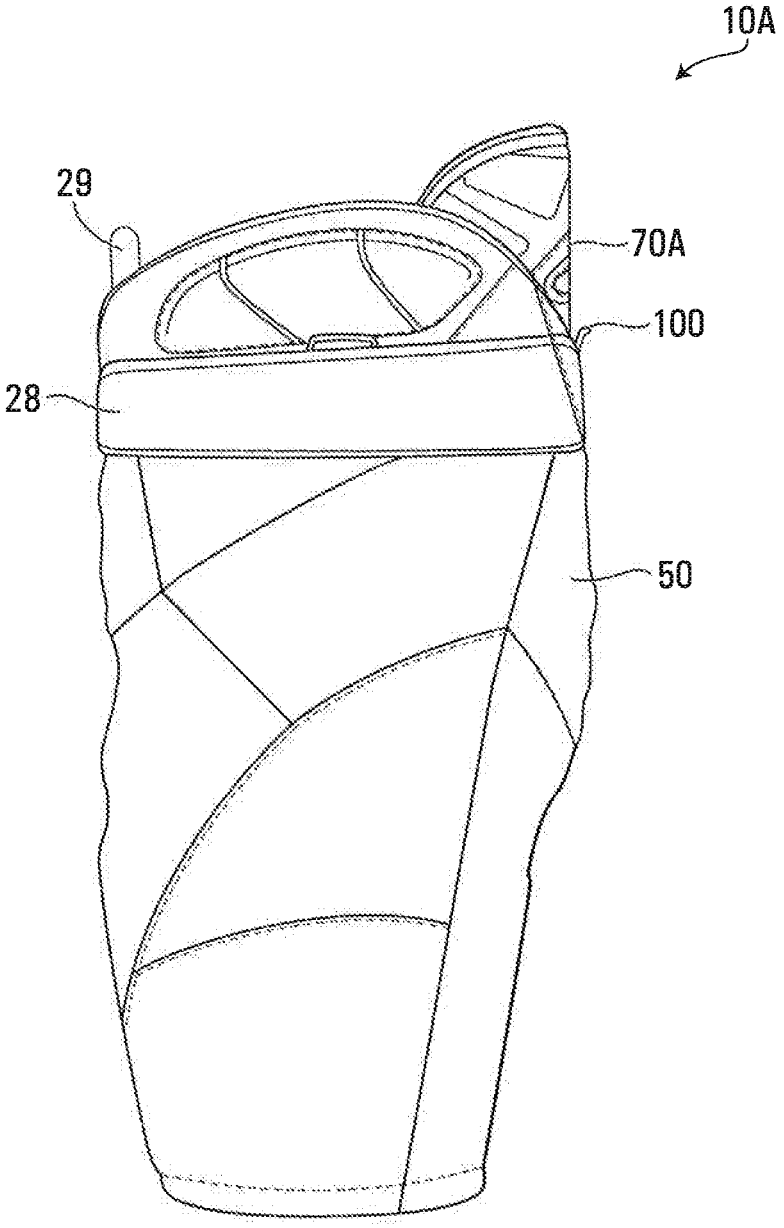

FIGS. 1A, 2 and 3 show an example of a protective pant 10A wearable by a wearer when engaging in a sport or another athletic activity to protect his/her body against injury. In this embodiment, the protective pant 10A is a hockey pant that provides impact protection to a lower body (e.g. a lower spine region, lower ribs, waist, pelvic region with left and right hips, crotch region, genital area, and left and right thighs) of the wearer who is a hockey player playing hockey. For example, the protective pant 10A may provide impact protection against, amongst other things, pucks, sticks and collisions with other players. Notably, this may be achieved by the protective pant 10A comprising protective padding.

As described in further detail herein, the protective pant 10A comprises a zipperless length adjuster 100 which allows an adjustment of a length L of the protective pant 10A, which refers to a dimension of the protective pant 10A in a vertical direction when worn by the player in a standing position. The zipperless length adjuster 100 is a structure of the protective pant 10A that is designed specifically to allow the length L of the protective pant 10A to be adjusted without operating any zipper to accommodate the player according to their fit preference or size, for example, if the player is still growing. To that end, no zipper needs to be operated to adjust the length L of the protective pant 10A when using the zipperless length adjuster 100A. The protective pant may still include one or more zippers, including one or more zippers for adjusting the length L of the protective pant 10A, but the zipperless length adjuster 100 as disclosed herein nevertheless allows the length L of the protective pant 10A to be adjusted without operating any zipper.

The protective pant 10A comprises a pelvic portion 20 and leg portions 30. The pelvic portion 20 overlies and provides impact protection to the wearer's pelvis while the leg portions 30 overlie and provide impact protection to the wearer's thighs. In this embodiment, the pelvic portion 20 comprises an upper pelvic portion 22, a lower pelvic portion 26 and a waist portion 28. With reference to FIG. 2, the upper pelvic portion 22 may include a belly portion 29 which overlies the wearer's lower abdomen, kidney portions 23 which overlie the wearer's kidneys and a lower spine portion 24 which overlies the wearer's lower spine. The lower pelvic portion 26 may include a crotch portion 27 overlying the wearer's crotch region. The waist portion 28 overlies the waist of the wearer.

Figure 1B:
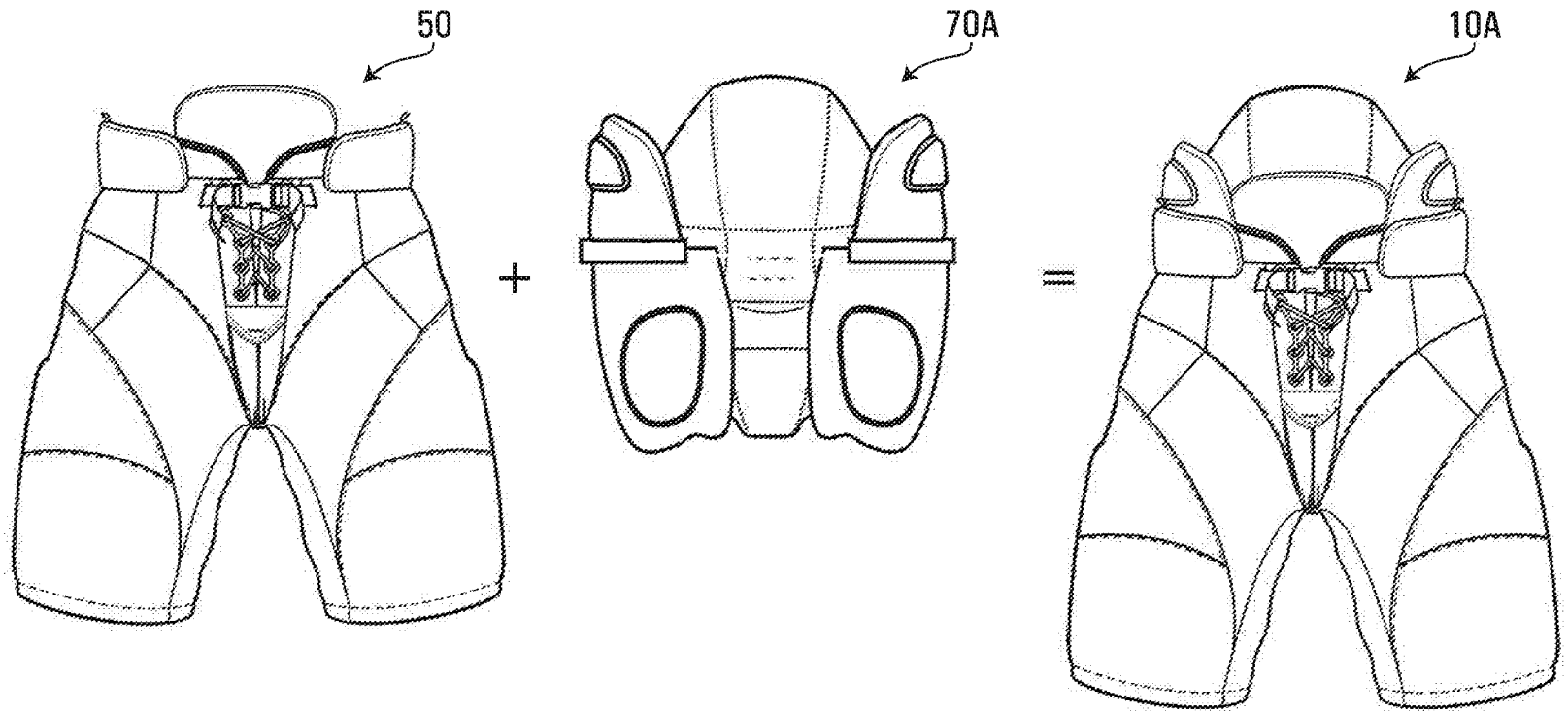
FIG. 1B is a front view of the protective pant illustrated in FIG. 1A deconstructed into an outer shell and an inner base in accordance with another embodiment.
Figure 5:
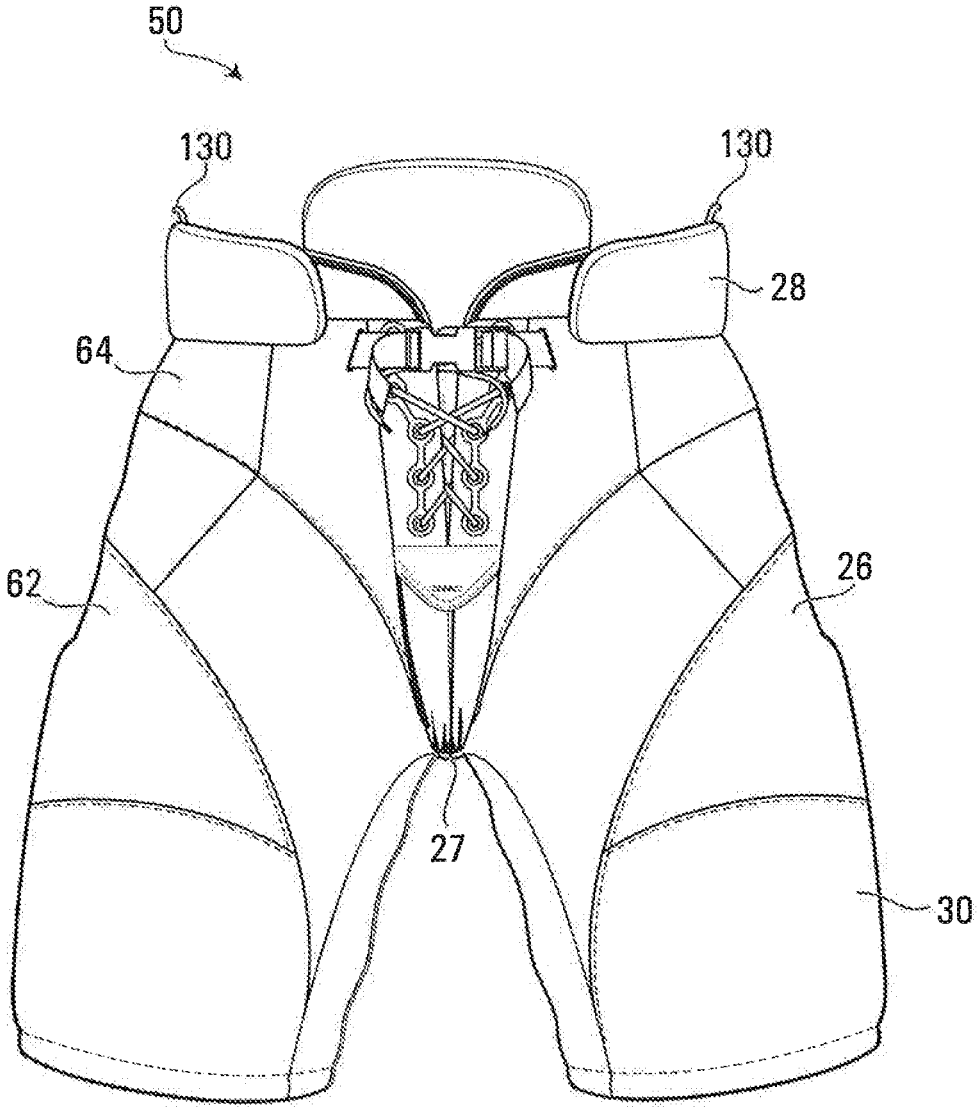
FIG. 5 is a front view of the outer shell of the protective pant in accordance with another embodiment.

With reference to FIG. 1B, the protective pant 10A may comprise an outer shell 50 which at least partly overlays an inner base 70A. The outer shell 50 has a front side 64, a rear side 66, and inner and outer sides 60, 62. Similarly, the inner base 70A has a front side 84, a rear side 86, and inner and outer sides 80, 82. As best shown in FIG. 5, the outer shell 50 may comprise parts of the aforementioned lower pelvic portion 26, the crotch portion 27, the waist portion 28, the leg portions 30 and parts of the upper pelvic portion 22, including the belly portion 29. Similarly and as best seen in FIGS. 6 and 8, the inner base 70A may comprise parts of the aforementioned leg portions 30, the waist portion 28, the crotch portion 27, the lower pelvic portion 26 and parts of the upper pelvic portion 22, including the kidney portion 23 and the lower spine portion 24.

The outer shell 50 may comprise a high strength material such as nylon. Moreover, the outer shell 50 fits generally loosely around the wearer's pelvis and thighs and thus typically does not need to be formed of a stretchy fabric, but will still accommodate significant skating movements of the player. However, the outer shell 50 may have stretch zones that employ a stretchy fabric so as to accommodate vigorous skating by the player. For instance, a stretch zone can be provided generally in the crotch portion 27 and in selected areas of high tension or high risk of binding when the player skates so that the outer shell 50 does not inhibit the skating motion.

Figure 6:
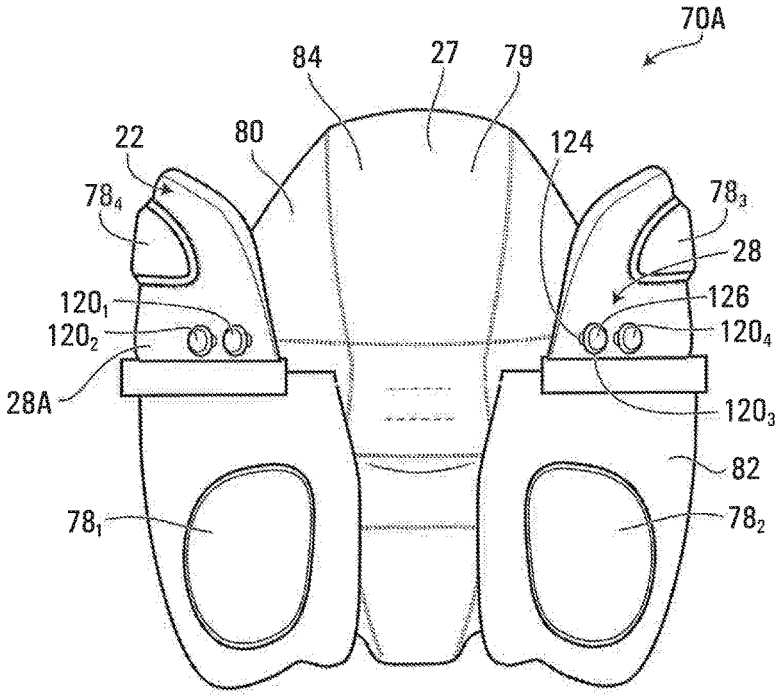
FIGS. 6 to 8 are respective front, side and rear views of the inner base of the protective pant in accordance with another embodiment.
Figure 7:
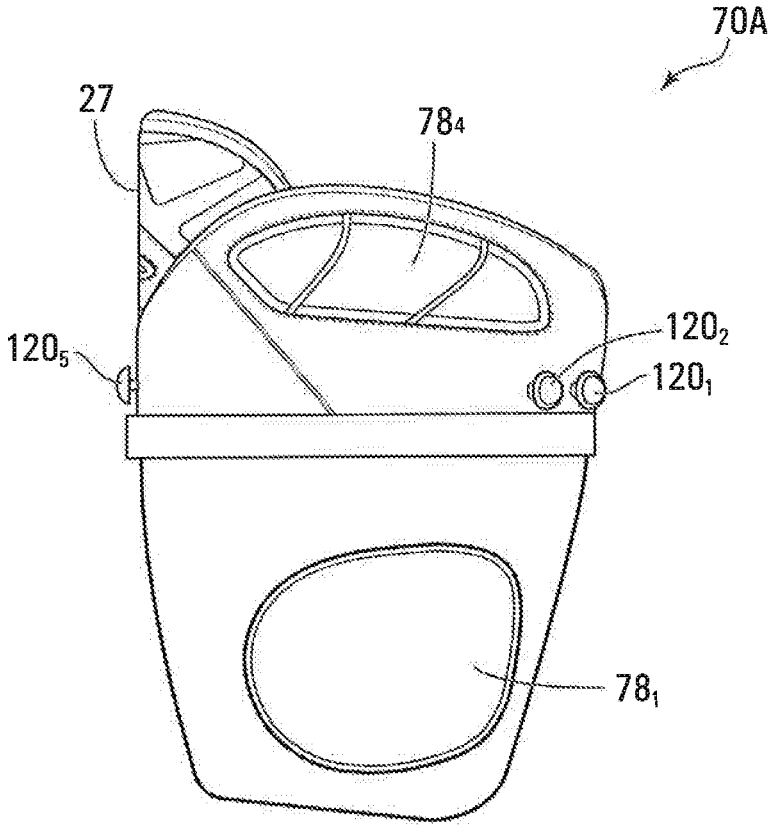
Figure 8:
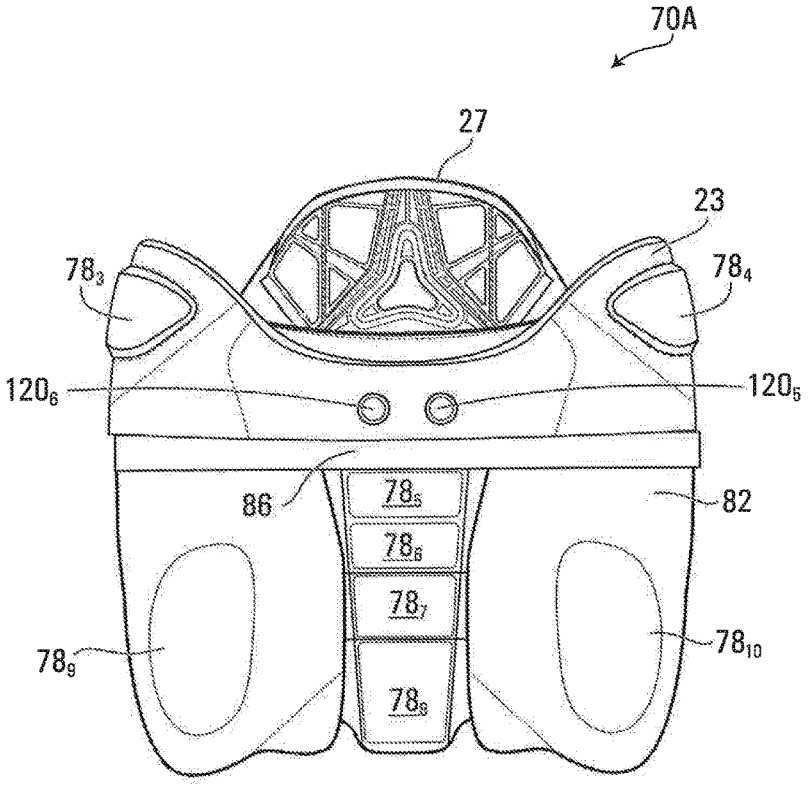

With reference to FIGS. 6 to 8, the inner base 70A is in the form of a short or girdle and is configured to provide a bulk of the impact protection to the protective pant 10A. To afford impact protection to the wearer, the inner base 70A comprises a plurality of (in this case twelve) padding elements $\mathbf{78}_1$-$\mathbf{78}_{10}$. Of course in other embodiments, there may be more or fewer than twelve padding elements $\mathbf{78}_1$-$\mathbf{78}_{10}$. The plurality of padding elements $\mathbf{78}_1$-$\mathbf{78}_{10}$ includes left and right upper thigh pads $\mathbf{78}_1$, $\mathbf{78}_2$ for at least partially covering the left and right upper thighs of the player, left and right hip pads $\mathbf{78}_3$, $\mathbf{78}_4$ for at least partially covering the left and right hips of the player and left and right upper thigh pads $\mathbf{78}_9$, $\mathbf{78}_{10}$. On its inner side 80, the inner base 70A also comprises a spine pad 79 located centrally relative to the inner base 70A and extending across the pelvic and waist portions 20, 28 thereof. The spine pad 79 comprises a soft material for providing a comfortable support for the player's spine and tailbone. As best shown in FIG. 8, at the same position but on the outer side 82, the inner base 70A comprises padding elements $\mathbf{78}_5$-$\mathbf{78}_8$ for providing impact protection to the player's spine and tailbone.

Figure 9:
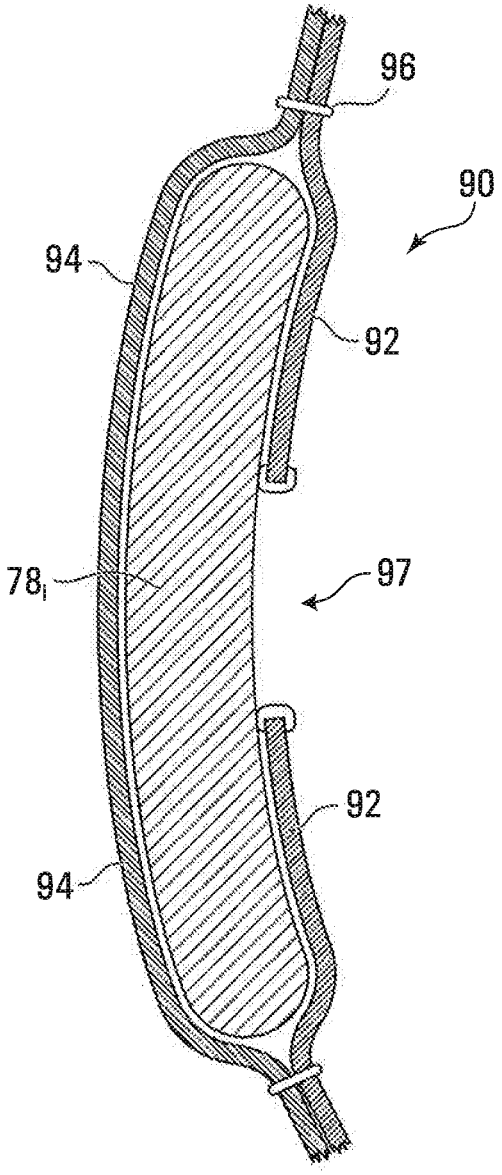
FIG. 9 is a lateral cross-sectional view of a pocket for the protective padding in accordance with another embodiment.

The padding elements $\mathbf{78}_1$-$\mathbf{78}_{10}$ may comprise any suitable material (e.g., polypropylene foam, high-density foam enclosed in polyethylene, etc.). As best seen in FIG. 9, a particular padding element $\mathbf{78}_i$ of the plurality of padding elements $\mathbf{78}_4$-$\mathbf{78}_{10}$ may be contained within a corresponding pocket 90 that is defined between first and second fabric layers 92, 94 of the inner base 70A. The first and second fabric layers 92, 94 of the inner base 70A may comprise a synthetic mesh material which may allow an increased breathability of the inner base 70A. The first and second fabric layers 92, 94 of the inner base 70A may comprise any other suitable material in other embodiments. In this embodiment, the pocket 90 is delimited by a stitching 96, however any other suitable method may be used to delimit the pocket 90. Moreover, in some cases, the padding element $\mathbf{78}_i$ may be inserted or removed from the pocket 90 (and therefore the inner base 70A) via an opening 97 of the pocket 90. The opening 97 is stretchable such that it may expand and retract to accommodate the insertion or removal of the padding element 78 into the pocket 90. However, it should be appreciated that not all of the padding elements $\mathbf{78}_1$-$\mathbf{78}_{10}$ need to be removable.

Figure 12:
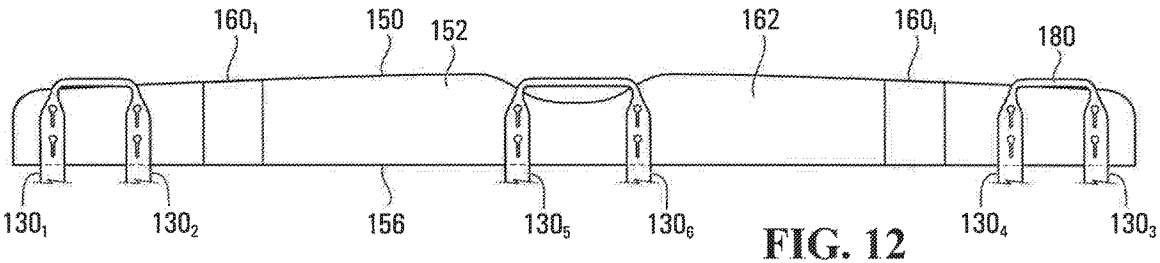
FIG. 12 shows an inner side of a padded belt in accordance with another embodiment.

With reference to FIGS. 1A and 12, the protective pant 10A may additionally comprise a padded belt 150. In this embodiment, the padded belt 150 may comprise a fabric such as a woven fabric, a nonwoven fabric, or any other suitable fabric overlaying a padded material which may comprise foam such as ethylene vinyl acetate (EVA) foam, expanded polypropylene (EPP) foam, expanded polyethylene (EPE) foam (e.g., low-density polyethylene (LDPE) foam), vinyl nitrile (VN) foam, polyurethane foam, or any other suitable foam. The padded belt 150 may be disposed in a predominantly horizontal direction when worn by the wearer in a standing position along the periphery of an outer component 28B of waist portion 28 situated on the outer side 62 of the outer shell 50. To that end, the padded belt 150 may have a predominantly rectangular profile with a longitudinal, dimension suitable to allow the padded belt 150 a majority of an arc length around the outer component 28B of the waist portion 28. The padded belt 150 may further comprise an inner surface 162 which overlays the outer shell 50 when the padded belt 50 is disposed on the periphery of the waist portion 28 of the protective pant 10A. The padded belt 150 may have any suitable thickness and width which allow a facilitated operation of the padded belt 150.

In some embodiments, the padded belt 150 may comprise a detachable section 152 capable of being detached, at least in part, from the outer component 28B of the waist portion 28 and subsequently reattached by the wearer, as well as a fixed section 154 which cannot be detached from the outer component 28B of the waist portion 28. To that end, the padded belt 150 may be affixed to the outer component 28B of the waist portion 28 along a pivot edge 156 of the padded belt 150 via belt stitching 158, creating a seam 159. With reference to FIG. 12, in this embodiment, the pivot edge 156 may comprise a predominantly horizontal edge of the padded belt 150 located furthest from the top 12 of the protective pant 10A in a direction along a vertical axis of the protective pant when worn by a wearer in a standing position (hereinafter referred to as the "longitudinal direction"), thus allowing the padded belt 150 to rotate axially about the pivot edge 156 upwardly into an attached position and downwardly into a detached position. A portion of the padded belt 150 may thus be permanently attached to the outer shell 50 at the seam 159, regardless whether the detachable section 152 of the padded belt 150 is in an attached or detached position, wherein the seam 159 defines the fixed section 154 of the padded belt 150. To that end, when the padded belt 150 is in an attached position, the inner surface 162 of the padded belt 160 overlays a covered section 164 of an inner component 28A of the waist portion 28.

With reference to FIG. 12, the detachable section 152 of the padded belt 150 may comprise at least one hook and loop fastener section $\mathbf{160}_1$ disposed on the inner surface 162 of the padded belt 150 configured to be interconnected with at least one corresponding hook and loop fastener section $\mathbf{160}_2$ (not shown) disposed on the inner component 28A of the waist portion 28. The hook and loop fastener sections $\mathbf{160}_1$, $\mathbf{160}_2$ may be affixed to the inner surface 162 of the padded belt 150 and the inner component 28A of the waist portion 28, respectively, by means of stitching although any other suitable method of affixing the hook and loop fastener sections $\mathbf{160}_1$, $\mathbf{160}_2$ may be used in other embodiments (e.g. ultrasonic welding or adhesive bonding).

The hook and loop fastener sections $\mathbf{160}_1$, $\mathbf{160}_2$ may be disposed to cover a portion of the inner surface 162 of the padded belt 150 and an equivalent portion of the covered section 164 of the inner component 28A of the waist portion 28, respectively, thus creating an interconnection between the at least one hook and loop fastener sections $\mathbf{160}_1$, $\mathbf{160}_2$ when the padded belt 150 is in the attached position so that they may be bound together. When the padded belt 150 is in the attached position the at least one hook and loop fastener sections $\mathbf{160}_1$, $\mathbf{160}_2$ thus retain the padded belt 150 in the attached position until a sufficiently strong pulling force is applied to the padded belt 150 to overcome the binding force of the interconnected hook and loop fastener sections $\mathbf{160}_1$, $\mathbf{160}_2$.

In order to accommodate the wearer according to their fit preference or size, the length of the protective pant 10A may be adjusted. In some embodiments this may be achieved by adjusting the distance between a top and a bottom of the protective pant 10A in the longitudinal direction.

Figure 4A:
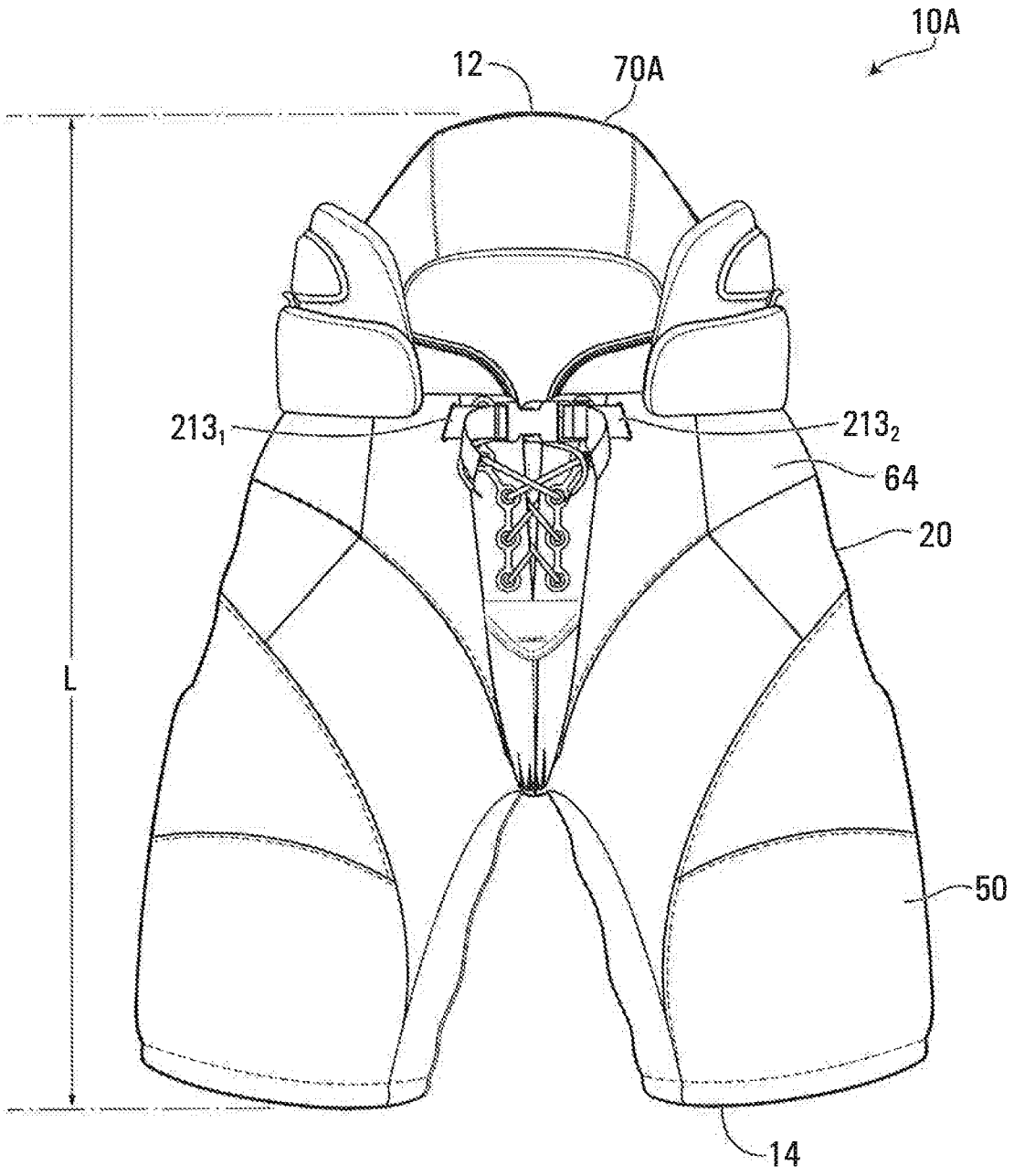
FIG. 4A is a front view of the protective pant illustrated in FIG. 1A indicating a length measurement of the protective pant.

For example, with reference to FIG. 4A, a top 12 of the protective pant 10A may be defined as the limit of the upper pelvic portion 22 extending away from the crotch portion 27 in the longitudinal direction, while the bottom 14 of the protective pant 10A may be defined as the limit of the leg portions 30 extending away from the crotch portion 27 in the longitudinal direction. As such, an adjustment of the length of the protective pant 10A may thus correspond to an adjustment of the position of the leg portions 30 relative to the pelvic portion 20 of the protective pant 10A in the longitudinal direction.

Figure 4B:
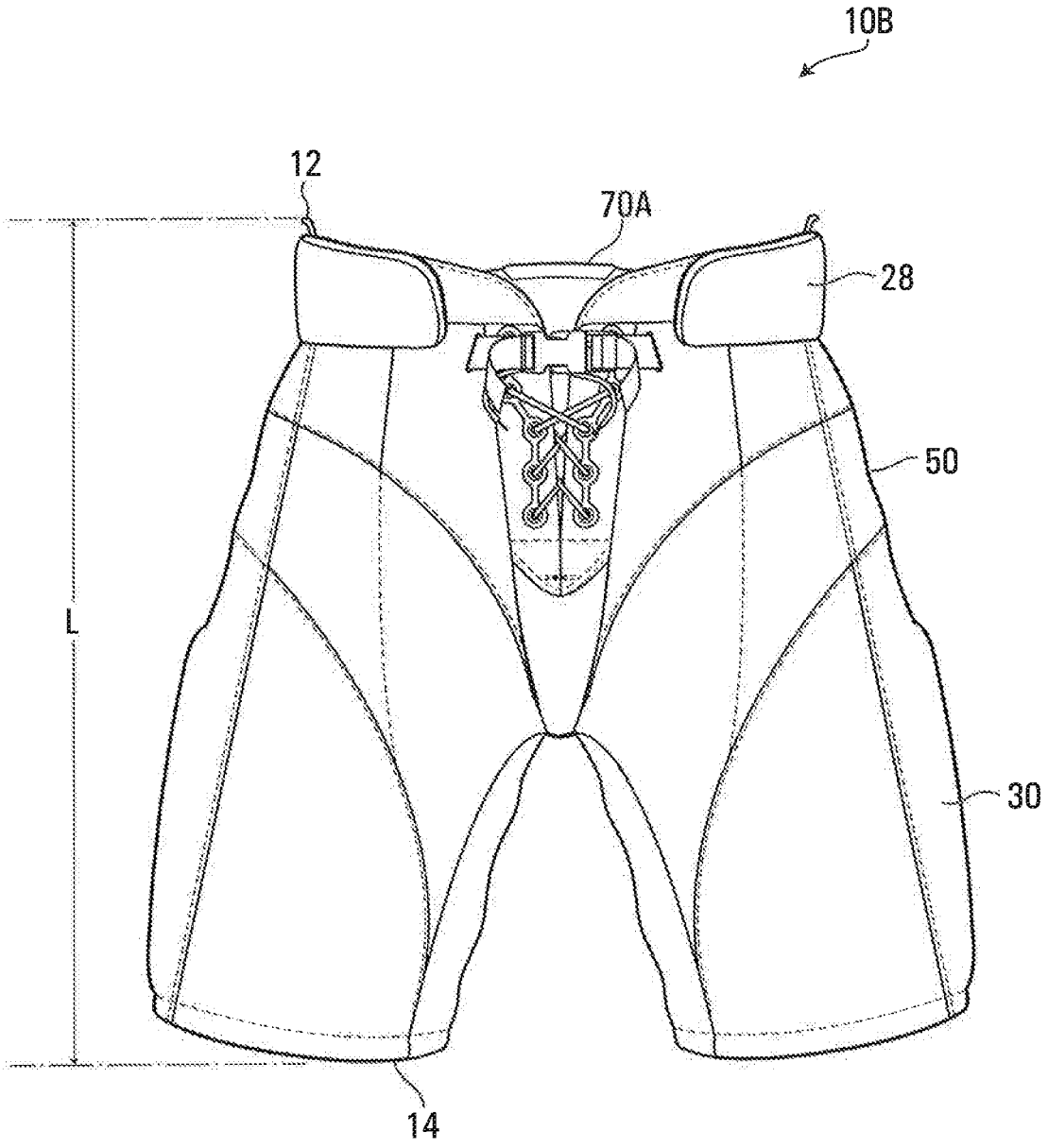
FIG. 4B is a front view of the protective pant in accordance with another embodiment.
Figure 4C:
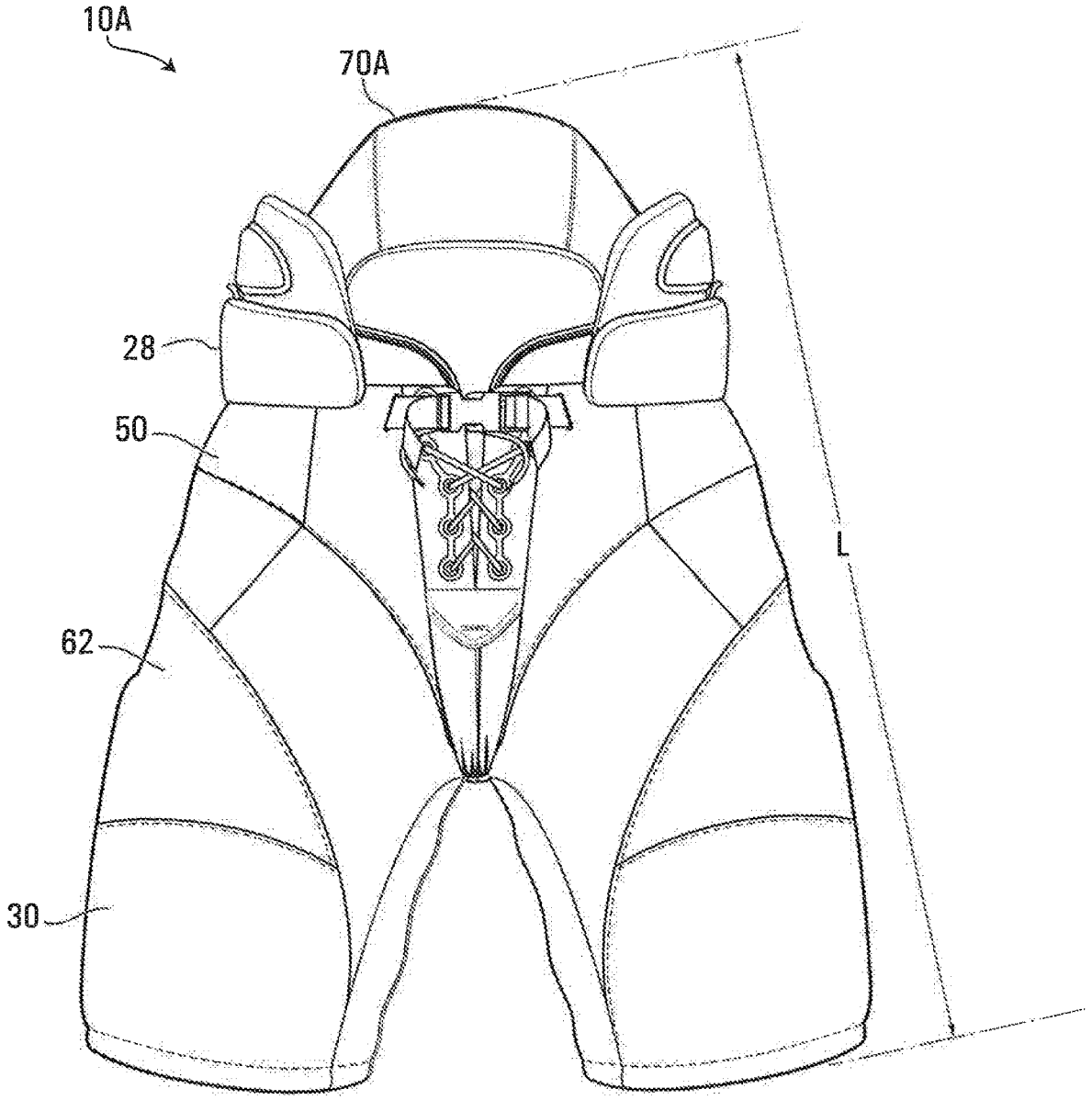
FIG. 4C is a front view of the protective pant illustrated in FIG. 1A indicating another length measurement of the protective pant.

It should be understood that other reference points for measuring the length of the protective pant in the longitudinal direction may be used. For example, as shown in FIG. 4C, the length of the protective pant 10A may defined as the distance between the limit of the waist portion 28 extending away from the crotch portion 27 in the longitudinal direction and the limit of the leg portions 30 extending away from the inner shell 70 in the longitudinal direction along the outer side 62 of the outer shell 50.

The length of the protective pant may be defined differently in different embodiments. In an alternative embodiment and as shown in FIG. 4B, a protective pant 10B comprises features analogous to those of the protective pant 10A, however the upper pelvic portion 22 of the protective pant 10B does not comprise the kidney portion 23, the lower spine portion 24 or the belly portion 29. In this alternative embodiment, the top 12 of the protective pant 10B may be defined as the limit of the waist portion 28 extending away from the crotch portion 27 in the longitudinal direction.

In the following, specific features that allow length adjustment of the protective pant will be described with reference to the protective pant 10A, although it should be understood that a similar description would apply in the case of the protective pant 10B.

In the case of protective pant 10A, adjustment of the length of the protective pant 10A is enabled by a zipperless length adjuster 100. In a specific example of implementation and with reference to FIG. 10A, the zipperless length adjuster 100 may comprise a first adjuster element 120 affixed to the inner base 70A and a second adjuster element 130 affixed to the outer shell 50. The first and second adjuster elements 120, 130 may be attachable to one another in at least two positions in the longitudinal direction to permit the zipperless adjustment of the length of the protective pant 10A.

Figure 11B:
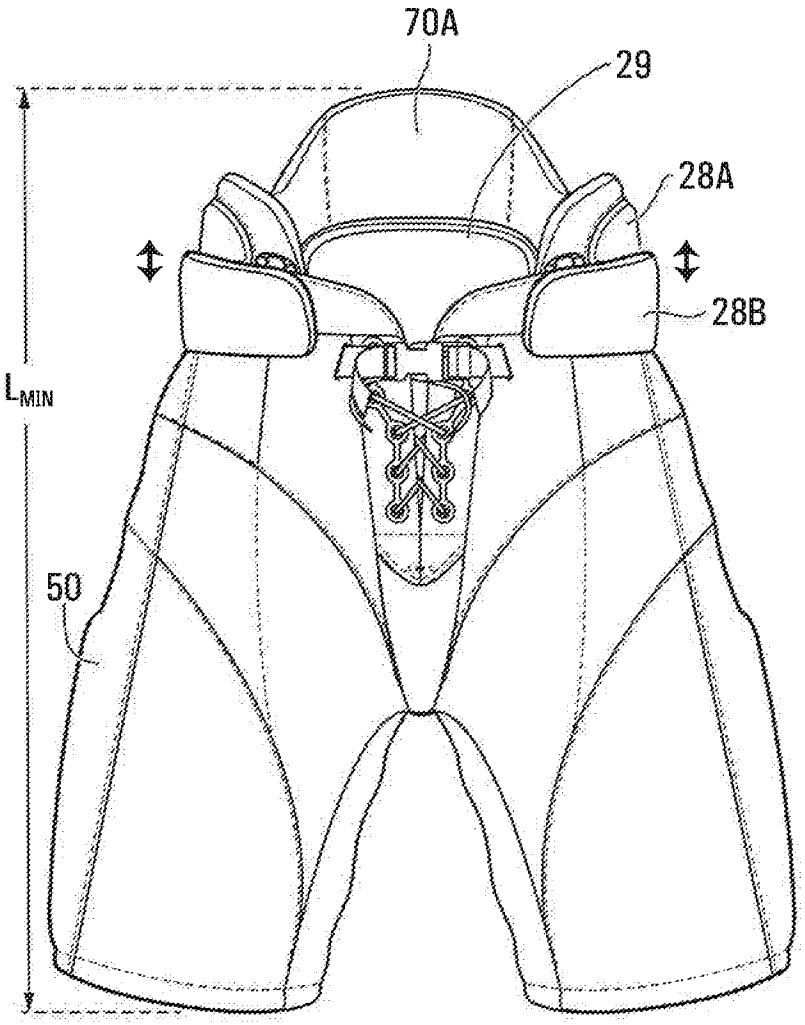
FIGS. 11A and 11B show a front view of the front of the protective pant for two different configurations of the zipperless length adjuster, respectively, in accordance with another embodiment.
Figure 11A:
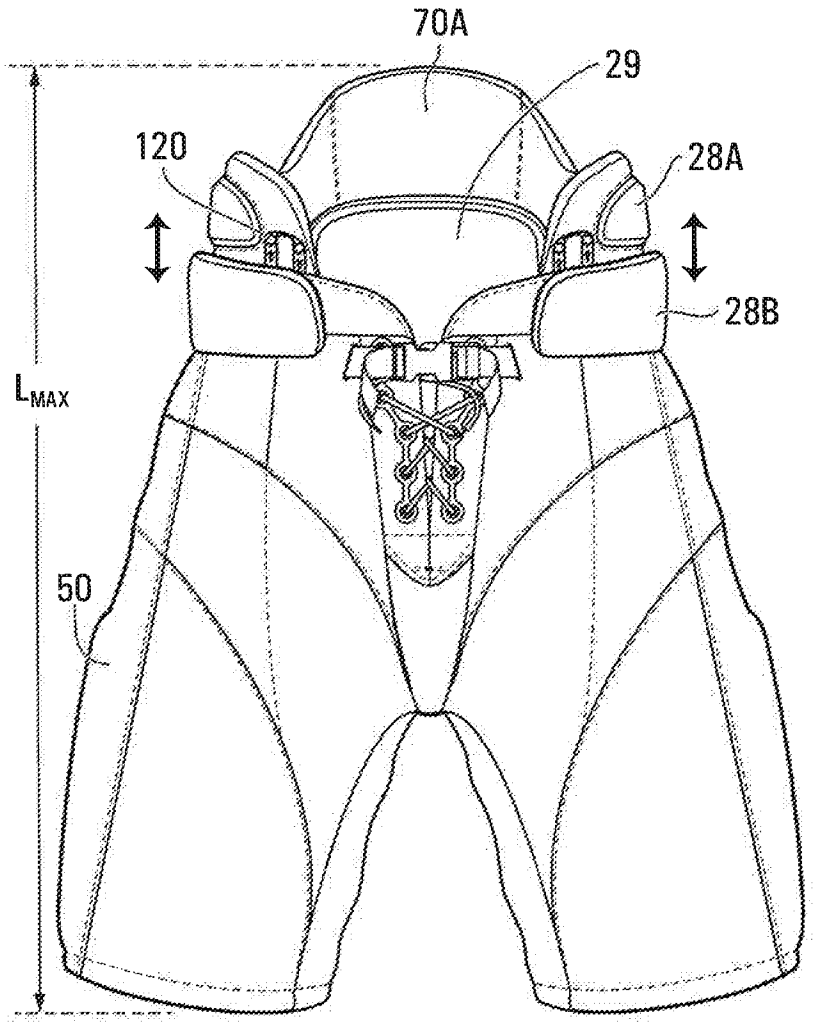

With reference to FIG. 11, the first adjuster element 120 is affixed to the inner component 28A of the waist portion 28 and the second adjuster element 130 is affixed to the outer component 28B of the waist portion 28. Attachment of the first and second adjuster elements 120, 130 is different positions may result in an adjustment of the inner component 28A of the waist portion 28 relative to the outer component 28B of the waist portion 28 in the longitudinal direction and therefore an adjustment of the length of the protective pant 10A. In the above described embodiment, the zipperless length adjuster 100 omits the use of a zipper in performing the function of attaching the inner base 70A and outer shell 50 to one another in the at least two longitudinal positions. However, this does not preclude the protective pant 10A from comprising other additional mechanisms for the attachment of the inner base 70A and the outer shell 50, where such additional mechanisms themselves may employ a zipper to allow an adjustment in the length of the protective pant 10A.

The zipperless length adjuster 100 may in fact comprise more than one first adjuster element (like first adjuster element 120) attached to the inner base 70A and more than one second adjuster element (like second adjuster element 130) attached to the outer shell 50. With reference to FIGS. 5 to 8, a set of (in this ease six) first adjuster elements $\mathbf{120}_1$-$\mathbf{120}_6$ of the zipperless length adjuster 100 are affixed to the inner component 28A of the waist portion 28 and a set of (in this case six) second adjuster elements $\mathbf{130}_1$-$\mathbf{130}_6$ of the zipperless length adjuster 100 are affixed to the outer component 283 of the waist portion 28. Of course in other embodiments, there may be more or fewer than six first adjuster elements $\mathbf{120}_1$-$\mathbf{120}_6$ and second adjuster elements $\mathbf{130}_1$-$\mathbf{130}_6$. As such, it is envisaged that each of the first adjuster elements $\mathbf{120}_1$-$\mathbf{120}_6$ of the zipperless length adjuster 100 may be affixed to the outer side 82 of the inner base 70A and each of the second adjuster elements $130_1$-$130_6$ of the zipperless length adjuster 100 may be affixed to the inner side 60 of the outer shell 50.

The sets of first and second adjuster elements $120_1$-$120_6$, $130_1$-$130_6$ of the zipperless length adjuster 100 may be distributed around a periphery of the waist portion 28. In particular, the first adjuster elements $120_1$-$120_6$ may be distributed around the periphery of the inner component 28A of the waist portion 28 and the second adjuster elements $130_1$-$130_6$ may be distributed around the periphery of the outer component 28B of the waist portion 28.

Various configurations exist for the distribution of the sets of first and second adjuster elements $120_1$-$120_6$, $130_1$-$130_6$ around the periphery of their respective inner and outer components 28A, 283 of the waist portion 28. One such configuration is an even distribution, and another such configuration is grouping in pairs. For example, and as shown in FIGS. 11 and 12, the first adjuster elements $120_1$-$120_6$ are disposed in three pairs around the periphery of the inner component 28A of the waist portion 28 with the corresponding second adjuster elements $130_1$-$130_6$ being disposed accordingly on the outer component 28B of the waist portion 28.

The first adjuster elements $120_1$-$120_6$ and the second adjuster elements $130_1$-$130_6$ may take on different forms in different embodiments, some of which will now be discussed. For example, with reference to FIGS. 10A and 10B, in one embodiment, a particular one of the first adjuster elements $120_1$-$120_6$ may comprise a button 122. The button 122 may be implemented as a disk made of a plastic material (e.g., nylon, polyethylene, silicon), or a stud which may be riveted to the inner base 70A, although any other suitable configuration may be used (e.g., a shank button or sew-through button). A particular one of the second adjuster elements $130_1$-$130_6$ may comprise a surface 134 containing a plurality of (in this case two) slits 132, wherein each of the slits 132A, 132B creates a respective opening 133A, 133B allowing access from a first side of the surface 134 to a second side of the surface 134. A greater number of longitudinally distributed slits 132 may be used so as to provide a greater number of options for length adjustment of the protective pant 10A.

In order to attach the inner base 70A and the outer shell 50, the button 122 of a particular first adjuster element $120_i$ of the plurality of first adjuster elements $120_1$-$120_6$ may be pushed through either of the openings 133A, 133B of one of the corresponding slits 132A, 132B of a corresponding second adjuster element $130_i$ of the plurality of second adjuster elements $130_1$-$130_6$ and retained therein, thus acting as a fastener. To that end, each of the slits 132A, 132B of the second adjuster element $130_i$ may be suitably dimensioned to accept the button 122 of the first adjuster element $120_i$ while providing some resistance to the button 122 being pushed out in order to prevent the button 122 of the first adjuster element $120_i$ from being unintentionally disengaged.

When the protective pant 10A is worn by a wearer, the inner base 70A is supported around the wearer's waist (as described further below) and the outer shell 50, being supported by the inner base 70A by means of the first and second adjuster elements $120_1$-$120_6$, $130_1$-$130_6$, is urged downwardly relative to the inner base 70A by gravity. As discussed above, in this embodiment, the first adjuster elements $120_1$-$120_6$ may be affixed to the inner base 70A and the second adjuster elements $130_1$-$130_6$ may be affixed to the outer shell 50, thus the second adjuster element $130_i$ being pulled downwardly relative to the first adjuster element $120_i$ causes the button 122 to press upwardly against a point 135 on an upper edge of either of the openings 133A, 133B when the outer shell 50 is supported by the inner base 70A.

Figure 10A:
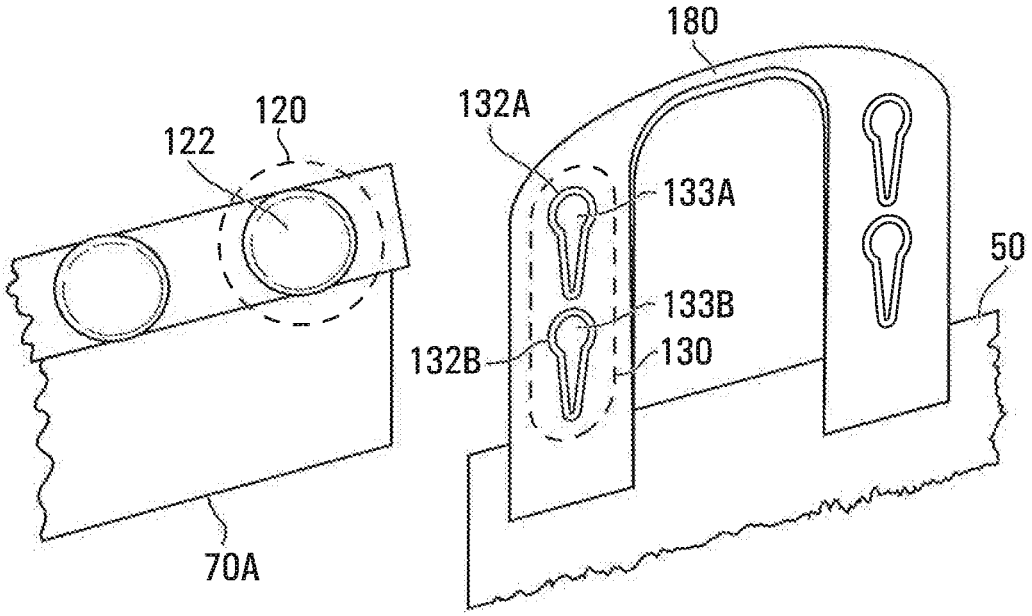
FIGS. 10A and 10B are enlarged views of a non-limiting example embodiment of a zipperless length adjuster in an unattached and attached configuration, respectively, in accordance with another embodiment.
Figure 10B:
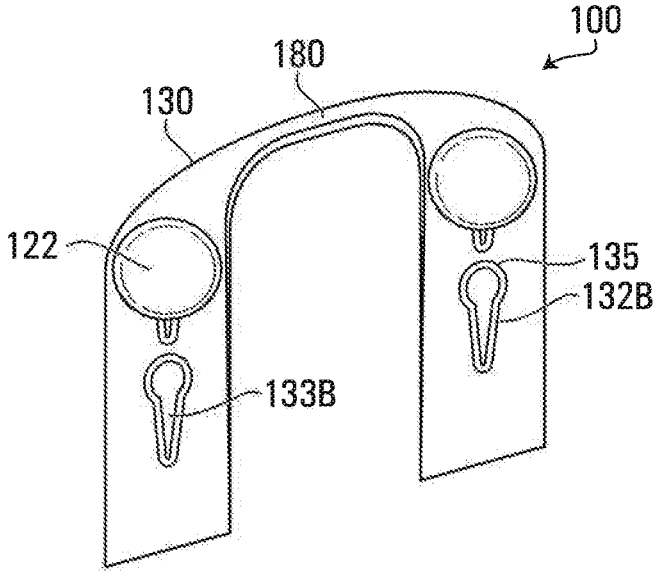

With continued reference to FIG. 10A, the slits 132A, 132B may be distributed along the longitudinal direction. The length of the protective pant 10A is thus adjusted by selecting different ones of the slits 132A, 132B with which to fasten the button 122, and this is done for each of the sets of first and second adjuster elements $120_1$-$120_6$, $130_1$-$130_6$. To that end, the zipperless length adjuster 100 may be adjusted according to a plurality of available lengths, wherein the number of such available lengths is defined by the number of slits 132A, 132B disposed on the surface 134 of each of the second adjuster elements $130_1$-$130_6$. Indeed, there may be more than two longitudinally distributed slits into which the button 122 may be inserted, thus giving a greater variety of lengths to which the protective pant 10A may be adjusted.

In another embodiment (not shown), each of the first adjuster elements $120_4$-$120_6$ may comprise a plurality of buttons similar to the button 122 affixed to the outer side 82 of the inner base 70A in the longitudinal direction and each of the second adjuster elements $130_1$-$130_6$ may comprise a single slit similar to a particular one of the slits 132. To that end, only a particular one of the plurality of buttons may be retained by the single slit at any given length, and the number of lengths is determined by the number of buttons.

The distance between the resting points 135 of the openings 133A, 133B of adjacent slits 132A, 132B in the longitudinal direction defines the difference between the various available lengths of the zipperless length adjuster 100. The length of the protective pant 10A may therefore be adjusted to accommodate the wearer by placing the button 122 of a particular one of the first adjuster elements $120_1$-$120_6$ into different ones of the slits 132A, 132B of the corresponding one of the second adjuster elements $130_1$-$130_6$. FIG. 11 shows the relative longitudinal displacement between the inner component 28A and outer component 28B of the waist portion 28 corresponding to the difference between a minimum length $L_{MIN}$ and a maximum length $L_{MAX}$ of the protective pant 10A. The difference between the minimum length $L_{MIN}$ and the maximum length $L_{MAX}$ of the protective pant 10A may be in some cases, at least 0.5", in some cases, at least 0.75", in some cases, at least 1", in some cases, at least 1.5" and in some cases, at least 2". The difference between adjacent length settings of the zipperless length adjuster 100 of the protective pant 10A, may be, in some cases, at least 0.5", in some cases, at least 0.75", and in some cases, at least 1". Also, not all length spacings need be equally spaced apart.

Figure 13:
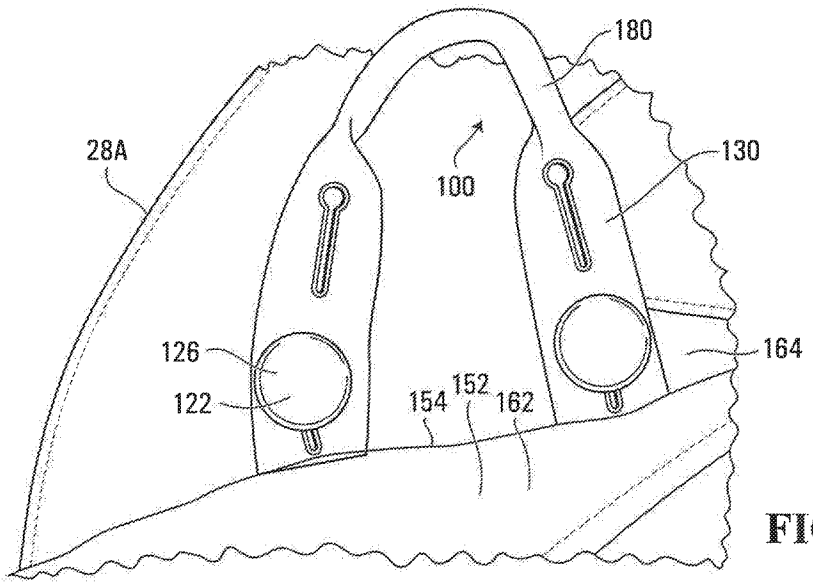
FIG. 13 is an enlarged view of the zipperless length adjuster comprising the padded belt and first and second adjuster elements in accordance with another embodiment.

In an embodiment, the zipperless length adjuster 100 may be concealed by the padded belt 150. As can be seen in FIG. 13, when the padded belt 150 is in the detached position, one or more of the aforementioned sets of first and second adjuster elements $120_1$-$120_6$, $130_1$-$130_6$ may become visible and accessible for operation of the zipperless length adjuster 100.

In the alternative, when the padded belt 150 is attached by means of the hook and loop fasteners $160_1$, $160_2$, the sets of first and second adjuster elements $120_1$-$120_6$, $130_1$-$130_6$ of the zipperless length adjuster 100 may be concealed so as to prevent accidental operation of the zipperless length adjuster 100 and to preserve aesthetics.

As shown in FIGS. 10 to 13, to facilitate operation of the zipperless length adjuster 100 of the protective pant 10A, the zipperless length adjuster 100 may comprise one or more tabs 180, each of which may in turn comprise one or more of the second adjuster elements $130_1$-$130_6$. In one embodiment, the one or more tabs 180 may be affixed to the outer shell 50 in any suitable way (e.g., stitching, ultrasonic welding or adhesive bonding). To that end, the one or more tabs 180 may be grasped by the wearer when operating the zipperless length adjuster 100. The tabs may have any suitable length and may extend beyond the upper edge of the padded belt 150 when the padded belt 150 is in an attached configuration (as shown in FIGS. 1A and 2). In another embodiment and as shown in FIG. 10A, one or more of the tabs 180 may form a loop wherein each loop forms a grasping member which can be easily gasped by the wearer for increased ease of use of the zipperless length adjuster 100 and wherein each of the tabs 180 comprises one or more second adjuster elements 130.

Figure 14:
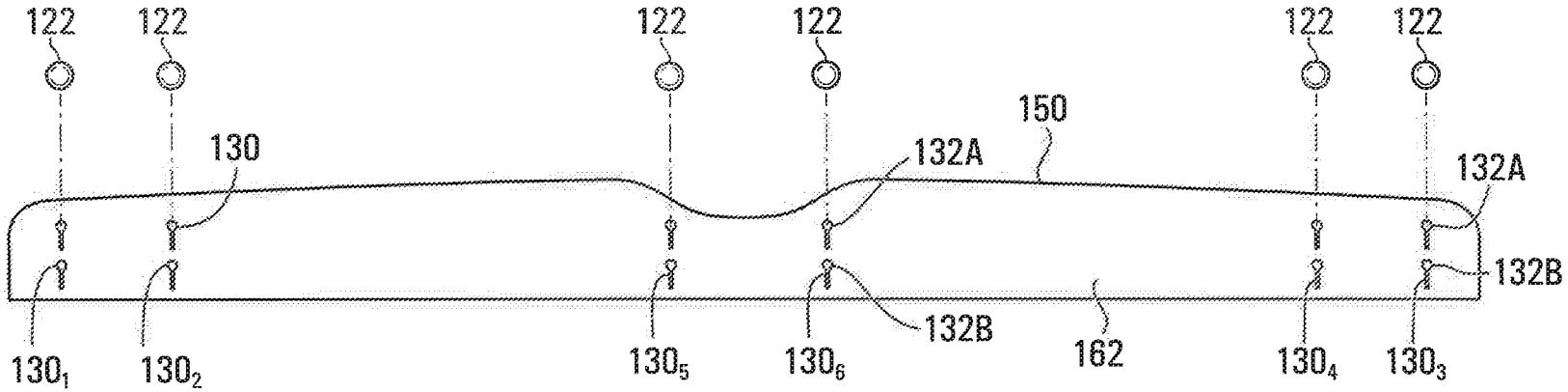
FIG. 14 shows an alternative embodiment of the padded belt.

In another embodiment and as shown in FIG. 14, one or more of the second adjuster elements $130_1$-$130_6$ of the zipperless length adjuster 100 may be incorporated into or integrated with the padded belt 150. For example, the inner surface 162 of the padded belt 150 may comprise the aforementioned slits 132A, 132B. In yet another embodiment (not shown), the second adjuster elements $130_1$-$130_6$ of the zipperless length adjuster 100 may be incorporated into or integrated with the inner side 60 of the outer shell 50.

Figure 15:
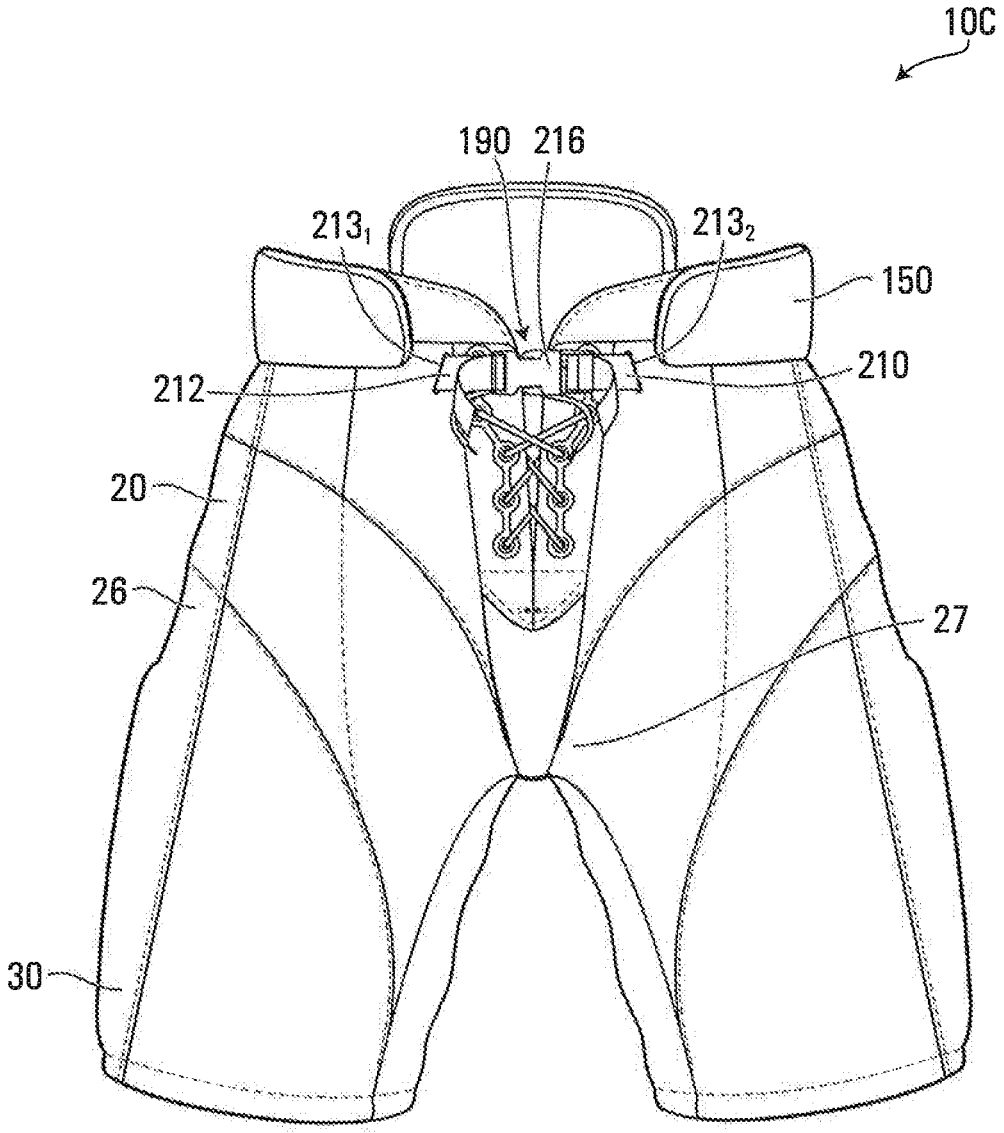
FIG. 15 is a front view of the protective pant in accordance with another embodiment.

In another non-limiting embodiment, the zipperless length adjuster may have a configuration based on retaining clips rather than buttons, while still allowing zipperless adjustment of the protective pant. Such a zipperless length adjuster may be used in a protective pant that is now described with reference to FIGS. 15 and 19A. Specifically, there is illustrated a protective pant 10C comprising features analogous to those of the protective pants 10A, 10B while incorporating a retaining system 190, wherein the retaining system 190 may support an inner base 70B around the wearer's waist. The inner base 70B comprises features analogous to those of the inner base 70A while incorporating retaining clips rather than buttons. The retaining system 190 may comprise a belt 210 and a belt connector 216 for fastening the belt 210 and adjusting a functional length thereof. In one embodiment, the belt 210 traverses from the outer side 62 to the inner side 60 of the outer shell 50. A first end 212 and a second end 214 of the belt 210 traverse from the inner side 60 to the outer side 62 of the outer shell 50 via respective belt openings $213_1$, $213_2$ located on the front side 64 of the outer shell 50. Hence, the first portion 212 of the belt 210 is disposed outside of the outer shell 50 and adjacent the outer side 62 of the outer shell 50 and the second portion 214 of the belt 210 is disposed inside the outer shell 50 and adjacent the inner side 60 of the outer shell 50 and the outer side 82 of the inner base 70B such that the second portion 214 of belt 210 at least partially encircles the inner base 70B at the waist portion 28.

The belt connector 216 of the belt 210 is located on the front side 64 of the outer shell 50 and comprises complementary buckle clips 217, 218 located proximate to the first and second ends 212, 214 of the belt 210. The complementary clips 217, 218 allow fastening the belt 210 and adjusting the functional length of the belt 210 (i.e. a distance between the clips 217, 218 measured along the belt 210 and along the waist portion 28). This allows adjusting the fit of the outer shell 50 and inner base 70B and thus the protective pant 10C around the waist of the wearer.

It should be noted that in an alternative embodiment, the retaining system 190 may comprise a pair of closable straps, wherein each closable strap comprises an end attached to the outer side 62 of the outer shell 50 along its waist portion 28, thus removing the necessity to have the second portion 214 of belt 210 at least partially encircling the inner base 70B at the waist portion 28. Similarly, the retaining system 190 may comprise a pair of closable straps, wherein each closable strap comprises an end attached to the outer side 82 of the inner base 70B along its waist portion 28.

Figure 19A:
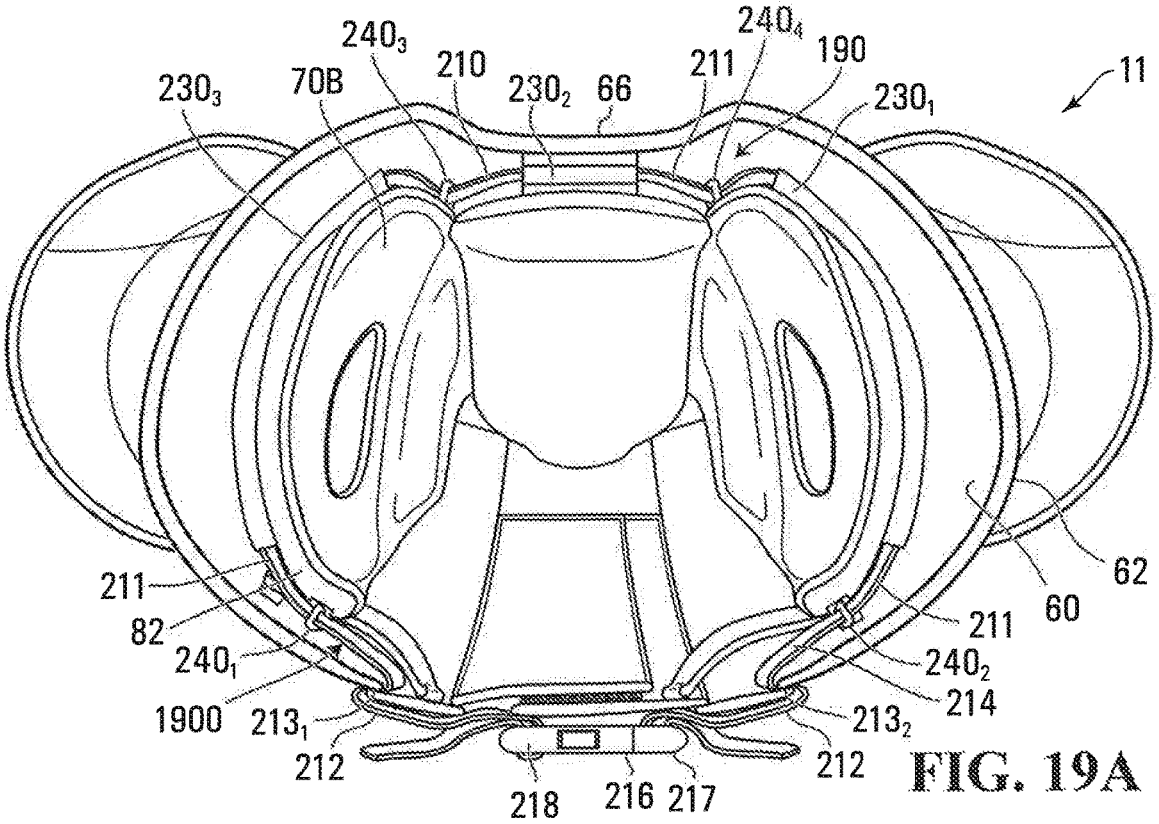
FIG. 19A is a top view of an example embodiment of the protective pant with the or shell being in a first position relative to the inner base.
Figure 19B:
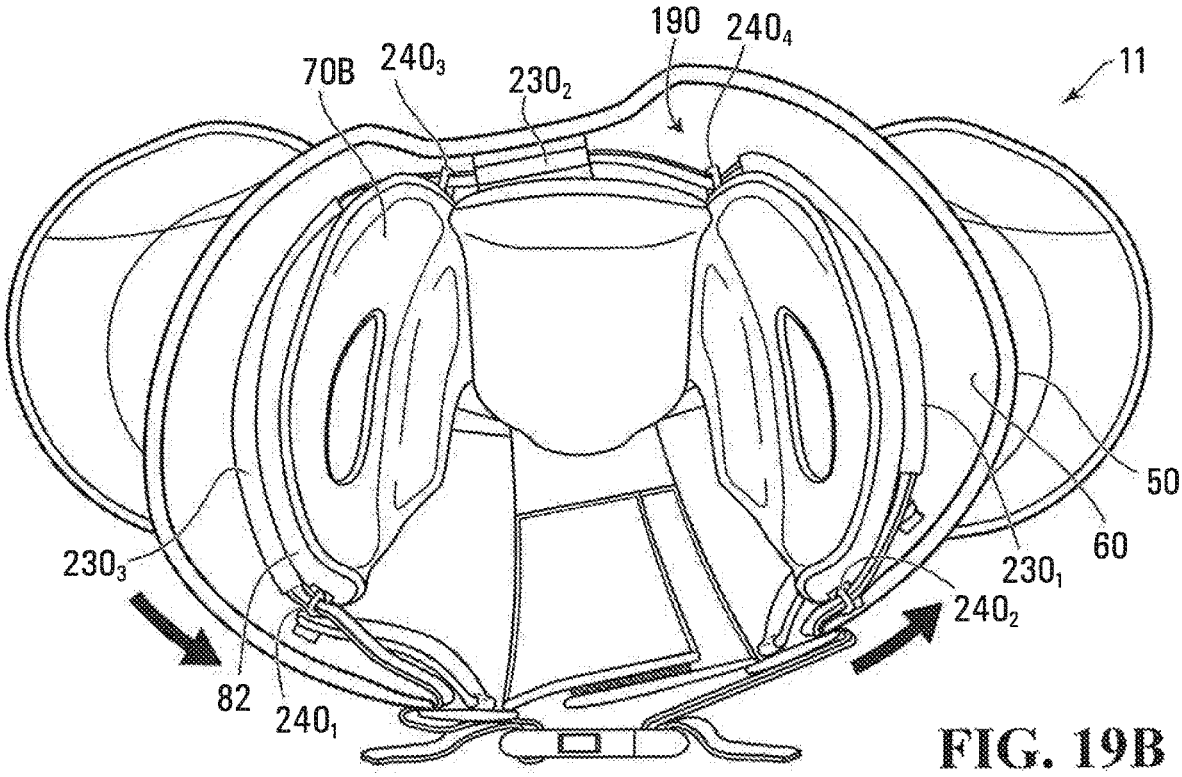
FIG. 19B is a top view of the protective pant of FIG. 18A with the outer shell being in a second position relative to the outer shell.

The belt 210 has a belt connector 216 for fastening the belt 210 and adjusting a functional length thereof. As best seen in FIGS. 19A and 19B, the protective pant 10C may comprise at least one sleeve 230 configured to accept the belt 210 while allowing slidable motion of the belt 210 within the sleeve, wherein the sleeve 230 comprises a strip of material folded onto itself and affixed at its lateral top end to the inner side 60 of the outer shell 50. In this embodiment, three sleeves 230 are affixed to the outer shell 50 via stitching. It should be noted that any other suitable method of retaining the belt 210 may be used while allowing movement of the outer shell 50 relative to the belt 210. For example, a plurality of hooks, loops or any other type of retainers configured to retain the belt 210 may be used.

On the inner side 60 of the outer shell 50, the belt 210 is partially contained within the sleeves 230 of the outer shell 50 and thus the belt 210 comprises a plurality of exposed portions 211 that are not contained within the sleeves 230. That is, each of the exposed portions 211 begins at the end of a sleeve 230 and ends at the beginning of the next sleeve 230. In this embodiment, the outer shell 50 comprises three sleeves 230, namely a left sleeve $230_1$, a rear sleeve $230_2$ and a right sleeve $230_3$. The belt comprises four exposed portions 211. It is understood that in other embodiments, the protective pant 10C may comprise more or less sleeves 230 and exposed portions 211.

Figure 17:
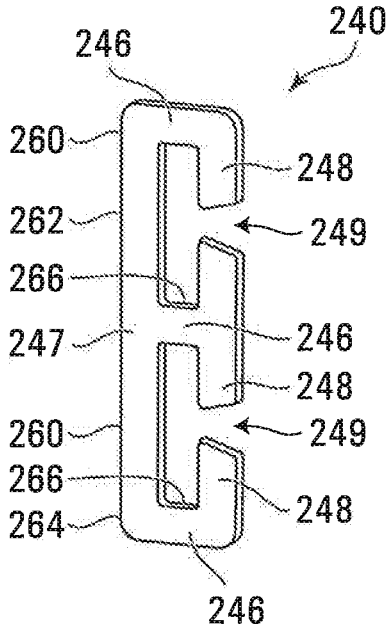
FIG. 17 is a perspective view of a retaining clip in accordance with another embodiment.

In this example of implementation and as shown in FIG. 19A, the zipperless length adjuster, now denoted by reference numeral 1900, is comprised of a plurality (in this case four) retaining clips $240_1$-$240_4$ and exposed portions 211 of the belt 210. The retaining clips $240_1$-$240_4$ have multiple longitudinal positions for receiving the belt 210. Specifically, a particular retaining clip $240_i$ of the plurality of retaining clips $240_1$-$240_4$ is configured to retain one of the exposed portions 211 of the belt 210. A backing 242 is provided for affixing the retaining clip $240_i$ to the inner base 70B or outer shell 50 and an attachment member 244 for affixing the retaining clip $240_i$ to the backing 242. In this embodiment and as best seen in FIG. 17, the retaining clip $240_i$ comprises two C-shaped sections 260 disposed consecutively and predominantly in the longitudinal direction, thus creating an upper C-shaped section 262 which is closest to the top 12 of the protective pant 10C in the longitudinal direction and a lower C-shaped section 264 which is furthest from the top 12 of the protective pant 10C in the longitudinal direction.

Each C-shaped section 260 of the retaining clip 240; comprises two transversal portions 246, a continuous longitudinal portion 247, and a discontinuous longitudinal portion 248. It is understood that the different portions of the retaining clip $240_i$ are "longitudinal" in that they extend predominantly in the longitudinal direction or "transversal" in that they extend in a direction transversal to the longitudinal direction. The discontinuous longitudinal portion 248 is "discontinuous" in that it defines an opening 249 proximate its midsection. It is also understood that the upper and lower C-shaped sections 262, 264 may comprise adjacent transversal portions 246 which are in contact with each other and which may, in certain embodiments, form one transversal portion 246 which defines lower and upper edges for the upper and lower C-shaped sections 262, 264, respectively. In this embodiment, the retaining clip $240_i$ comprises a plastic material (e.g., nylon, polyethylene, silicon), in other embodiments, the retaining clip 240$_i$ may comprise any other suitable material such as metal.

Figure 18:
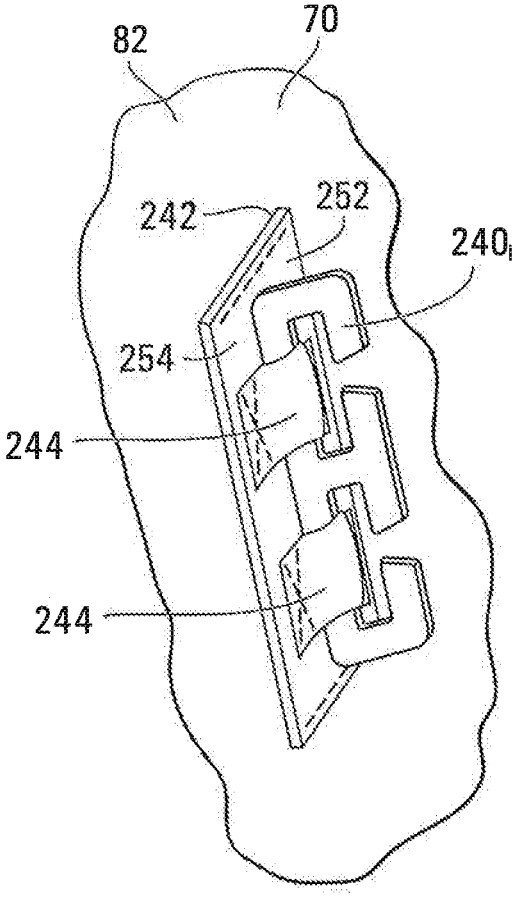
FIG. 18 is a fragmentary perspective view of the retaining clip affixed to the inner base in accordance with another embodiment.

FIG. 18 illustrates the retaining clip 240$_i$ attached to the backing 242, wherein the backing 242 comprises a rigid member 252 and a layer of fabric 254 overlying the rigid member 252. The rigid member 252 may comprise a strip of plastic material (e.g., nylon, polyethylene, silicon) or any other suitable material. A stitching is used to affix the backing 242 onto the outer side 82 of the inner base 70B. Any other suitable method of affixing the backing 242 to the inner base 70B may be used in other embodiments (e.g. ultrasonic welding or adhesive bonding). In some embodiments, the layer of fabric 254 may be omitted altogether.

The attachment members 244 are adapted to affix the retaining clip 240$_i$ to the backing 242 and to the inner base 70B. To this end, the attachment members 244 comprises a strip of fabric that overlies the continuous longitudinal portion 247 of each C-shaped section 260 of the retaining clip 240$_i$ and is affixed to the backing 242 and to the inner base 70B via stitching that may traverse both the backing and the inner base 70B. The retaining clip 240$_i$ is thus secured to the outer side 82 of the inner base 70B while maintaining an alignment in the predominantly longitudinal direction. It is understood that the attachment member 244 and/or backing 242 may be omitted in other embodiments where the retaining clip 240$_i$ can be directly or indirectly affixed to the inner base 70B.

In order to engage a particular exposed portion 211$_i$ of the plurality of exposed portions 211 to the retaining clips 240$_i$, the exposed portion 211; is slipped into the opening 249 of the discontinuous longitudinal portion 248 of the retaining clip 240$_i$ such that the exposed portion 211$_i$ is entirely bound by the two transversal portions 246, the continuous longitudinal portion 247, and the discontinuous longitudinal portion 248 of the retaining clip 240$_i$. Due in part to its geometry, the retaining clip 240$_i$ prevents the exposed portion 211$_i$ from accidentally slipping out through the opening 249 and becoming disengaged from the retaining clip 240$_i$ and the exposed portion 211$_i$ may rest on an inner surface 266 of the C-shaped section 266 located on the lower of the transversal portions 246 in the longitudinal direction and facing upwards towards the top 12 of the protective pant 10C. In order to disengage the exposed portion 211$_i$ from the retaining clip 240$_i$, the exposed portion 211; is slipped through the opening 249 of the discontinuous longitudinal portion 248 of the retaining clip 240$_i$.

Figure 16:
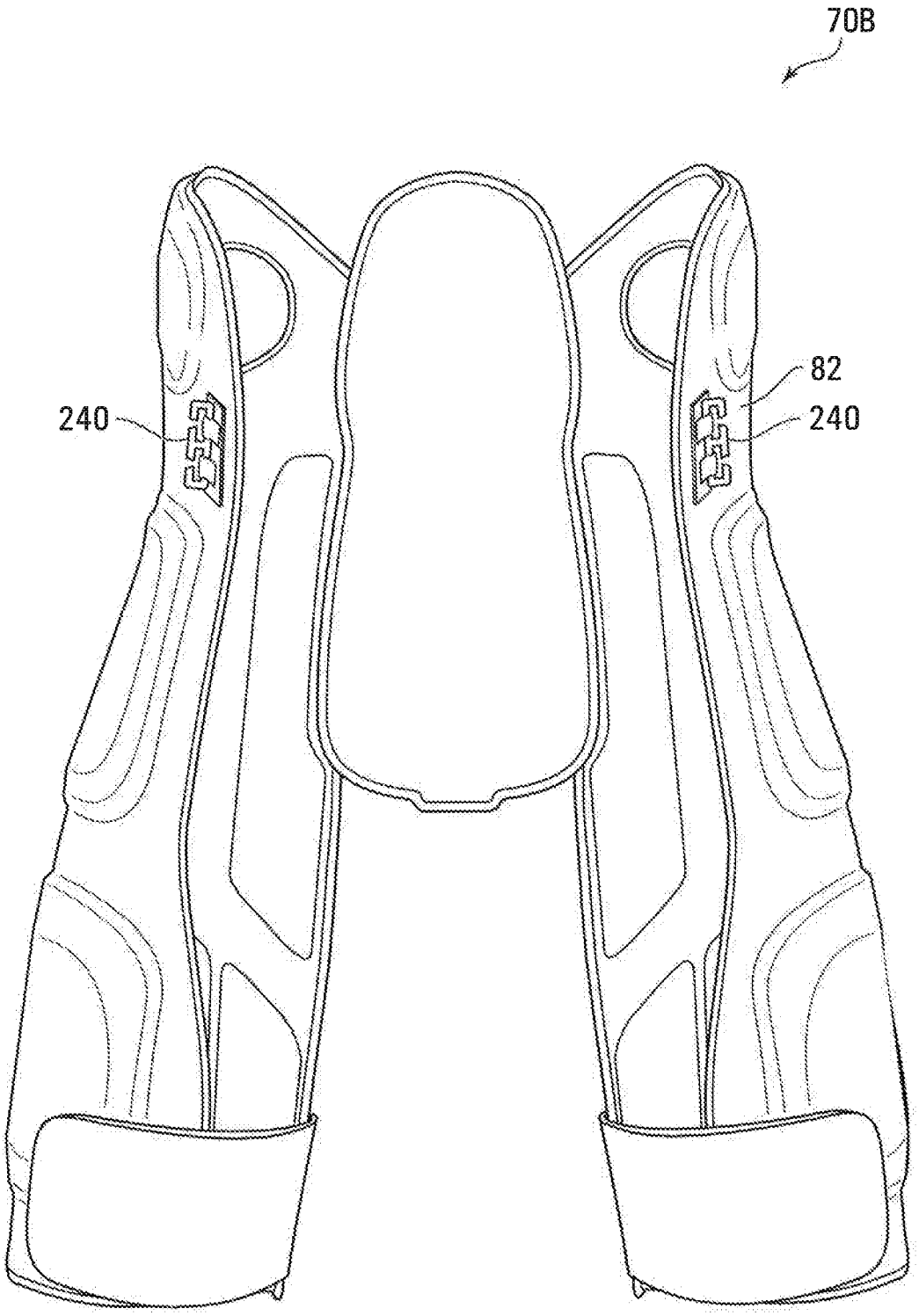
FIG. 16 is a front view of the inner base of the protective pant in accordance with another embodiment.

Each of the exposed portions 211 of the belt 210 may be engaged by one or more of the plurality of retaining clips 240$_1$-240$_4$. To that end, as best shown in FIGS. 16 and 19A, the zipperless length adjuster 1900 comprises left and right front retaining clips 240$_1$, 240$_2$ mounted to the front side 84 of the outer side 82 of the inner base 70B at the waist portion 28, and left and right rear retaining clips 240$_3$, 240$_4$ mounted to the rear side 86 of the outer side 82 of the inner base 70B at the waist portion 28. The belt 210 is then removably received in the retaining clips 240$_1$-240$_4$ such that the outer shell 50 is removable from the inner base 70B. It is understood that the belt remains on the outer shell 50 when the outer shell 50 is removed from the inner base 70B.

The wearer of the protective pant 10C may adjust the length of the protective pant 10C by engaging the exposed portions 211 with either of the C-shaped sections 260 of the corresponding one of the retaining clips 240$_1$-240$_4$, whereby the upper and lower C-shaped sections 262, 264 thus representing different lengths of the protective pant 10C. In this embodiment, an engagement of the belt 210 with the upper C-shaped section 262 of each of the retaining clips 240$_1$-240$_4$ would result in a protective pant 10C with the minimum length $L_{MIN}$. Similarly, an engagement of the belt 210 with the lower C-shaped section 264 of each of the retaining clips 240$_1$-240$_4$ would result in a protective pant 10C with the maximum length $L_{MAX}$. The resulting variation in length of the protective pant 10C is the distance in the longitudinal direction between the inner surface 266 of the lower of the transversal portions 246 of the upper C-shaped section 262 and the inner surface 266 of the lower of the transversal portions 246 of the lower C-shaped section 264.

In certain embodiments (not shown), the retaining clip 240$_1$-240$_4$ may comprise more than two longitudinally disposed C-shaped sections 260, thus allowing for an increased number of variations in length of the protective pant 10C with the number of C-shaped section 260 on each of the retaining clips 240 representing the number of adjustable lengths of the protective pant 10C.

Figure 20:
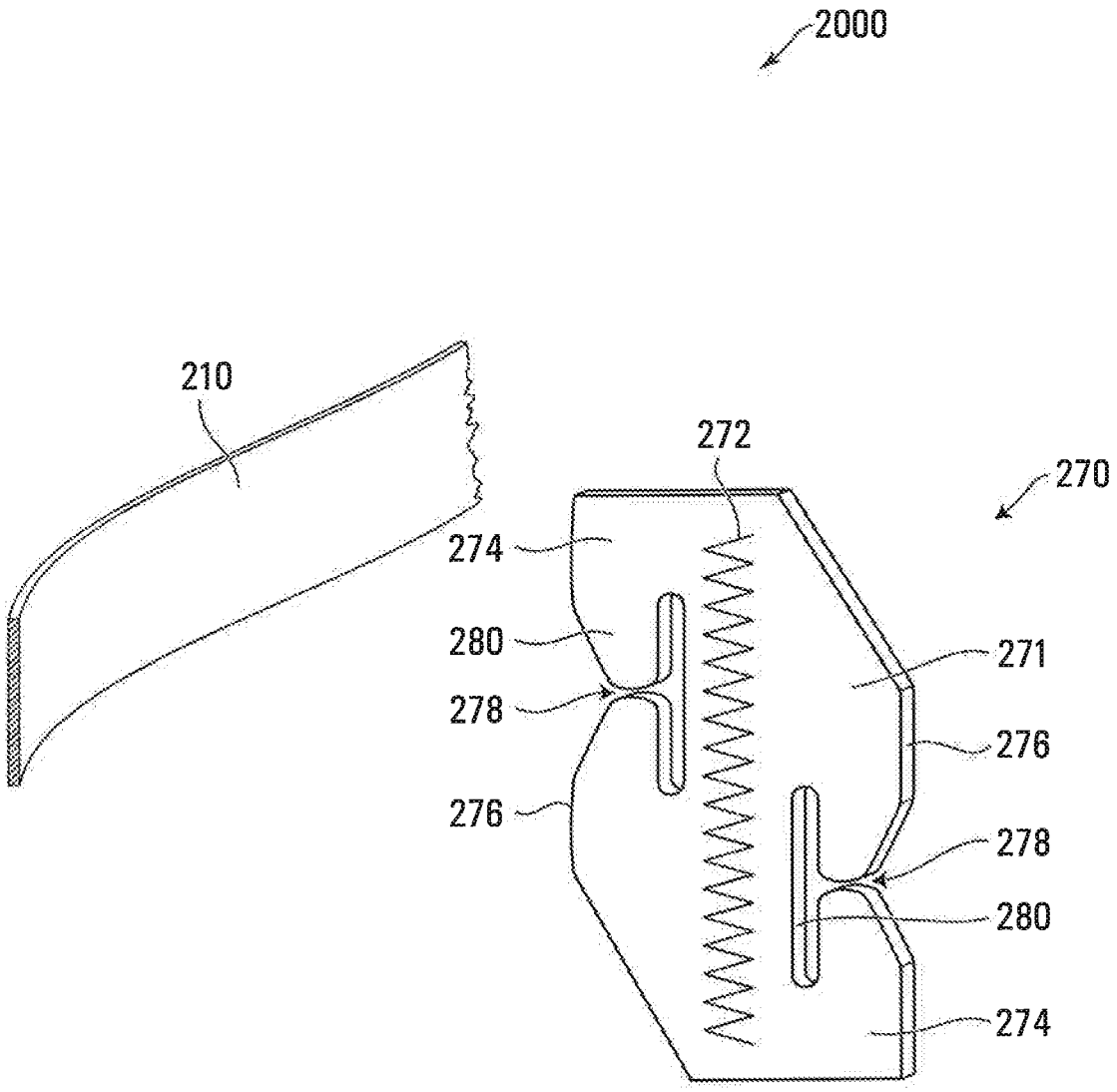
FIG. 20 is a perspective view of a retaining plate in accordance with another embodiment.

In another example of implementation and as shown in FIG. 20, the zipperless length adjuster, now denoted by the reference numeral 2000, may comprise a plurality of retaining plates. The retaining plates have multiple longitudinal positions for receiving one of the exposed portions 211. Specifically, a particular retaining plate 270 comprises a face 271. The retaining plate 270 may be affixed to the outer side 82 of the inner base 70B by means of stitching creating a seam 272 disposed predominantly in the longitudinal direction and centered horizontally on the retaining plate 270. Each side of the retaining plate 270 may therefore form a cantilever plate 274 extending laterally from the seam 272, wherein each of the edges of the cantilever plate 274 opposite to the seam 272 defines a cantilever edge 276 which is not affixed to the outer side 82 of the inner base 70B. Each of the cantilever edges 276 comprises an access slit 278 creating an opening normal to the cantilever edge 276 and along the face 271 of the retaining plate 270. Each cantilever plate 274 further comprises a plurality of retaining slits 280 disposed predominantly in the longitudinal direction which can be accessed by way of the access slits 278. The length of each retaining slit 280 may be sufficient to accept the belt 210. The retaining plate 270 may comprise a flexible plastic (e.g., flexible vinyl, flexible PVC, etc.) or any other suitable material.

To that end, the exposed portion 211$_i$ may be slipped into one of the access slits 278 disposed along one of the cantilever edges 276 of one of the cantilever plates 274 of the retaining plate 270 and subsequently passed into the connected retaining slit 280 such that the exposed portion 211$_i$ of the belt 210 is entirely bound by the retaining slit 280. In order to disengage the exposed portion 211$_i$ from the retaining slit 280, the exposed portion 211$_i$ is slipped out of the retaining slit 280 through the access slit 278 disposed along the cantilever edge 276 of the cantilever plate 274.

To that end, the retaining system 190 provides a means for easily adjusting the length of the protective pant 10C. However, this does not preclude the protective pant 10C from comprising other additional mechanisms for the attachment of the inner base 70B and the outer shell 50 or the provision of a zipper to allow an adjustment in the length of the protective pant 10C.

As can be seen from the above embodiments and as shown in FIGS. 19A and 19B, in addition to being separable from the inner base 70B when the protective pant 10C is not in use, the protective pant 10C may allow relative motion of the outer shell 50 relative to the inner base 70B while in use by the wearer. In particular, this may permit rotational movement of the shell relative to the base to allow a greater range of motion and/or greater wearer comfort when gyrating during skating.

Those skilled in the art will appreciate that the outer shell 50, which may be detachable from the inner base 70B using the zipperless length adjuster 100 (or 1900 or 2000), could be sold separately from the inner base 703. This allows interchangeability of the outer shell 50 with other outer shells having a compatible zipperless length adjuster in the event that the outer shell 50 becomes damaged or if the wearer desires to obtain an outer shell with different colours to conform to a new team's colours or due to personal taste. This may additionally allow the same inner base 70B to be used with a larger size outer shell 50 even as the wearer grows beyond a maximum comfortable length of a currently sized outer shell despite its zipperless length adjustability.

While the protective pants 10A, 10B, 10C have been described as a hockey pant, it should be understood that the protective pant 10A could be any other type of athletic pant or could be used in any other field of application, such as industrial, law enforcement, etc.

Certain additional elements that may be needed for operation of some embodiments have not been described or illustrated as they are assumed to be within the purview of those of ordinary skill in the art. Moreover, certain embodiments may be free of; may lack and/or may function without any element that is not specifically disclosed herein.

Any feature of any embodiment discussed herein may be combined with any feature of any other embodiment discussed herein in some examples of implementation.

In case of any discrepancy, inconsistency, or other difference between terms used herein and terms used in any document incorporated by reference herein, meanings of the terms used herein are to prevail and be used.

Although the invention has been disclosed in the context of certain embodiments and examples, it is understood that other alternative embodiments, obvious modifications and equivalents are possible. In addition, while a number of embodiments have been shown and described, other modifications will be readily apparent to a skilled person based upon the present disclosure. It is also understood that various features and aspects of the disclosed embodiments can be combined with or substituted for one another in order to form other variants. Thus, various modifications and enhancements will become apparent to those of ordinary skill in the art and are within the scope of the invention, which is defined by the appended claims.

What is claimed is:

1. A protective pant for a wearer, the protective pant comprising:

a pelvic portion for overlying a pelvic region of the wearer to provide impact protection to the pelvic region of the wearer, the pelvic portion comprising a waist portion for overlying a waist of the wearer;

leg portions for overlying thighs of the wearer to provide impact protection to the thighs of the wearer;

a zipperless length adjuster configured to adjust a length of the protective pant; and a padded belt overlying the waist portion of the protective pant, the padded belt having a fixed portion connected to the waist portion along a pivot edge, the padded belt having a detachable section configured to be attachable to and detachable from the waist portion, the padded belt having:

an attached configuration when the detachable section of the padded belt is attached to the waist portion of the pant; and a detached configuration when the detachable section of the padded belt is detached from the waist portion of the pant;

wherein: in the attached configuration, the padded belt conceals the zipperless length adjuster; and in the detached configuration, the padded belt is rotatable about the pivot edge to reveal the zipperless length adjuster.

2. The protective pant of claim 1, wherein the zipperless length adjuster is configured to adjust the length of the protective pant by adjusting a position of the leg portions relative to the pelvic portion in a longitudinal direction of the protective pant.

3. The protective pant of claim 1, wherein the pelvic portion comprises the waist portion for overlying a waist of the wearer and the zipperless length adjuster is configured to adjust the length of the protective pant by adjusting a distance between the waist portion and a bottom of each of the leg portions.

4. The protective pant of claim 3, wherein the pelvic portion comprises an upper pelvic portion and a lower pelvic portion and the waist portion is disposed between the upper pelvic portion and the lower pelvic portion.

5. The protective pant of claim 4, wherein the upper pelvic portion comprises kidney portions for overlying kidney regions of the wearer.

6. The protective pant of claim 4, wherein the upper pelvic portion comprises a lower spine portion for overlying a lower spinal region of the wearer.

7. The protective pant of claim 1, wherein the pelvic portion comprises a crotch portion for overlying a crotch of the wearer and the zipperless length adjuster is disposed above the crotch portion.

8. The protective pant of claim 1, wherein the protective pant comprises an inner base and an outer shell overlying the inner base.

9. The protective pant of claim 8, wherein the zipperless length adjuster is configured to adjust the length of the protective pant by adjusting a position of the outer shell relative to the inner base in a longitudinal direction of the protective pant.

10. The protective pant of claim 8, wherein the outer shell is movable relative to the inner base.

11. The protective pant of claim 10, wherein the outer shell is separable from the inner base and removable from the protective pant.

12. The protective pant of claim 8, wherein the zipperless length adjuster comprises a first adjuster element and a second adjuster element that is positionally adjustable relative to the first adjuster element in a longitudinal direction of the protective pant to adjust the length of the protective pant.

13. The protective pant of claim 12, wherein the first adjuster element is attached to the inner base and the second adjuster element is attached to the outer shell, the inner base and outer shell being attachable to one another via the first and second adjuster elements in at least two longitudinal positions corresponding to different values of the length of the protective pant.

14. The protective pant of claim 13, wherein the outer shell comprises the padded belt, the first adjuster element comprises a button, and the second adjuster element comprises a plurality of slits in the padded belt at different length-wise positions, into which the button is insertable.

15. The protective pant of claim 13, wherein the first adjuster element is one of a plurality of first adjuster elements of the zipperless length adjuster, wherein the second adjuster element is one of a plurality of second adjuster elements of the zipperless length adjuster, and wherein the protective pant further comprises a plurality of tabs affixed to the outer shell and each of which comprises at least some of said second adjuster elements, wherein the padded belt spans an arc length around the wearer when the protective pant is worn, and wherein the plurality of tabs are distributed along said arc length.

16. The protective pant of claim 13, wherein one of the first and second adjuster elements includes a button and the other of the first and second adjuster elements includes a plurality of slits at different length-wise positions, into which the button is insertable.

17. The protective pant of claim 16, wherein the first adjuster element is one of a plurality of first adjuster elements of the zipperless length adjuster and wherein the second adjuster element is one of a plurality of second adjuster elements of the zipperless length adjuster.

18. The protective pant of claim 17, wherein each of either the first or second adjuster elements includes a button and wherein each of the other of the first or second adjuster elements includes a corresponding plurality of slits at different length-wise positions, into which the corresponding button is insertable.

19. The protective pant of claim 17, further comprising at least one tab affixed to the outer shell and comprising at least some of said second adjuster elements.

20. The protective pant of claim 19, wherein the at least one tab protrudes from an edge of the outer shell.

21. The protective pant of claim 20, wherein the at least one tab comprises a grasping member for being grasped by the wearer when adjusting the length of the protective pant.

22. The protective pant of claim 21, further comprising the padded belt affixed to the outer shell, wherein at least part of the padded belt is detachable and reattachable to the outer shell by the wearer, wherein the grasping member is at least partly covered by the padded belt when said part of the padded belt is attached to the outer shell and is at least partly revealed by the padded belt when said part of the padded belt is detached from the outer shell.

23. The protective pant of claim 21, wherein the grasping member comprises a loop.

24. The protective pant of claim 23, wherein the at least one tab comprises a plurality of tabs joined by the loop, each of the plurality of tabs including a respective subset of the second adjuster elements, each subset including at least two second adjuster elements in different length-wise positions.

25. The protective pant of claim 1, wherein the zipperless length adjuster comprises a first adjuster element and a second adjuster element that is positionally adjustable relative to the first adjuster element in a longitudinal direction of the protective pant to adjust the length of the protective pant.

26. The protective pant of claim 1, wherein the zipperless length adjuster is configured to allow the length of the protective pant to be adjusted by at least 0.5 inches.

27. The protective pant of claim 1, wherein the zipperless length adjuster is configured to allow the length of the protective pant to be adjusted by at least 0.75 inches.

28. The protective pant of claim 1, wherein the zipperless length adjuster is configured to allow the length of the protective pant to be adjusted by at least 1 inch.

29. The protective pant of claim 1, wherein each of the leg portions comprises protective padding.

30. The protective pant of claim 29, wherein the protective padding comprises foam.

31. The protective pant of claim 29, wherein the pelvic portion comprises protective padding.

32. The protective pant of claim 29, wherein the protective padding of each of the leg portions comprises foam and the protective padding of the pelvic portion comprises foam.

33. The protective pant of claim 1, wherein the protective pant is a hockey pant.

34. The protective pant of claim 1, wherein the padded belt remains attached to the waist portion by a seam when partly detached.

35. The protective pant of claim 34, wherein the seam is disposed around a majority of an arc length of the waist portion.

36. The protective pant defined in claim 1, wherein the pivot edge comprises a seam.

37. The protective pant defined in claim 1, wherein the padded belt is configured to rotate downwardly about the pivot edge into a detached position.

38. The protective pant defined in claim 1, wherein the padded belt is configured to rotate upwardly about the pivot edge into an attached position.

39. A protective pant for a wearer, the protective pant comprising:

an inner base for protecting the wearer, the inner base comprising a pelvic portion for overlying a pelvic region of the wearer to provide impact protection to the pelvic region of the wearer, the pelvic portion comprising a waist portion for overlying a waist of the wearer;

an outer shell comprising: a pelvic portion for overlying a pelvic region of the wearer, the pelvic portion comprising a waist portion for overlying a waist of the wearer; and leg portions for overlying thighs of the wearer; and a zipperless length adjuster comprising a plurality of adjustment elements on the inner base and a plurality of adjustment elements on the outer shell, each of the adjustment elements on the outer shell configured to be attachable to a corresponding one of the adjustment elements of the inner base in at least two positions to permit length-wise adjustment of the outer shell relative to the inner base;

wherein the outer shell comprises a padded belt overlying the waist portion of the outer shell, the padded belt having a fixed portion connected to the waist portion of the outer shell along a pivot edge, the padded belt having a detachable section configured to be attachable to and detachable from the waist portion of the outer shell, the padded belt having: an attached configuration when the detachable section of the padded belt is attached to the waist portion of the outer shell; and a detached configuration when the detachable section of the padded belt is detached from the waist portion of the outer shell;

wherein: in the attached configuration, the padded belt conceals the zipperless length adjuster; and in the detached configuration, the padded belt is rotatable about the pivot edge to reveal the zipperless length adjuster.

40. The protective pant defined in claim 39, wherein the pivot edge comprises a seam, wherein the padded belt is configured to rotate downwardly about the pivot edge into a detached position and wherein the padded belt is configured to rotate upwardly about the pivot edge into an attached position.

41. The protective pant of claim 39, wherein: the outer shell comprises an anterior portion and a posterior portion; and the padded belt, in the attached configuration, defines an uppermost point of the anterior portion of the outer shell.

42. The protective pant of claim 39, wherein: the outer shell comprises an anterior portion and a posterior portion; the outer shell comprises an uppermost point of the anterior portion that is configured to overly the waist of the wearer.

43. The protective pant of claim 39, wherein: the inner part of the protective pant comprises hip pads for at least partially covering left and right hips of the wearer, a part of each hip pad being disposed above the outer shell and being exposed to an exterior of the protective pant.

44. A removable outer shell for covering an inner base of a protective pant, the removable outer shell comprising: a pelvic portion for overlying a pelvic region of the wearer, the pelvic portion comprising a waist portion for overlying a waist of the wearer; and leg portions for overlying thighs of the wearer;

the removable outer shell comprising a padded belt overlying the waist portion of the outer shell, the padded belt overlying at least one adjustment element configured to be attachable to a corresponding one of at least one adjustment element of the inner base in at least two positions to permit zipperless length-wise adjustment of the removable outer shell relative to the inner base; the padded belt having a fixed portion connected to the waist portion of the outer shell along a pivot edge, the padded belt having a detachable section configured to be attachable to and detachable from the waist portion of the outer shell, the padded belt having:

an attached configuration when the detachable section of the padded belt is attached to the waist portion of the outer shell; and a detached configuration when the detachable section of the padded belt is detached from the waist portion of the outer shell;

wherein: in the attached configuration, the padded belt conceals the zipperless length adjuster; and in the detached configuration, the padded belt is rotatable about the pivot edge to reveal the zipperless length adjuster.

* * * * *